US008240498B2

(12) United States Patent
Ramsey et al.

(10) Patent No.: US 8,240,498 B2
(45) Date of Patent: Aug. 14, 2012

(54) RESEALABLE CLOSURE

(75) Inventors: Christopher Paul Ramsey, Wantage (GB); Alexandre Paris, Abingdon (GB)

(73) Assignee: Crown Packaging Technology, Inc., Alsip, IL (US)

( * ) Notice: Subject to any disclaimer, the term of this patent is extended or adjusted under 35 U.S.C. 154(b) by 1010 days.

(21) Appl. No.: 11/591,041

(22) Filed: Oct. 31, 2006

(65) Prior Publication Data

US 2008/0110887 A1 May 15, 2008

(51) Int. Cl.
*B65D 51/18* (2006.01)

(52) U.S. Cl. ..... 220/254.3; 220/254.1; 215/237

(58) Field of Classification Search ..... 220/319, 220/834, 254.1, 254.3, 791, 906, 269; 215/253, 215/250, 237
See application file for complete search history.

(56) References Cited

U.S. PATENT DOCUMENTS

| | | | | |
|---|---|---|---|---|
| 3,250,425 | A | 5/1966 | Stec et al. | 220/54 |
| 3,262,612 | A | 7/1966 | Tabor | |
| 3,287,053 | A | 11/1966 | Stec et al. | 292/256.63 |
| 3,386,613 | A | 6/1968 | Traynor | |
| 3,406,867 | A | 10/1968 | Westphal et al. | 220/270 |
| 3,447,713 | A | 6/1969 | Stec et al. | 220/54 |
| 3,450,301 | A | 6/1969 | Stec et al. | 220/273 |
| 3,520,440 | A | 7/1970 | Kinnavy et al. | 220/783 |
| 3,622,034 | A | 11/1971 | Lutzker et al. | |
| 3,705,670 | A | 12/1972 | Douty | |
| 3,744,662 | A | 7/1973 | Zundel | |
| 3,788,512 | A | 1/1974 | Brahler | |
| 3,871,544 | A | 3/1975 | Peyser | |
| 3,910,410 | A | 10/1975 | Shaw | |
| 3,952,911 | A | 4/1976 | Bozek et al. | |
| 4,054,205 | A | 10/1977 | Blow, Jr. et al. | |
| 4,098,439 | A | 7/1978 | Blow, Jr. et al. | |
| 4,122,970 | A | 10/1978 | Amabili | |
| 4,127,221 | A * | 11/1978 | Vere | 222/153.02 |
| 4,136,797 | A | 1/1979 | Potts | |
| 4,150,777 | A | 4/1979 | Cyr et al. | |
| 4,266,688 | A | 5/1981 | Reid | |
| 4,361,244 | A | 11/1982 | Walter | 215/253 |
| 4,369,888 | A | 1/1983 | Walter | 215/237 |
| 4,397,400 | A | 8/1983 | Walter | |
| 4,397,403 | A | 8/1983 | Guimarin | |
| 4,407,423 | A | 10/1983 | Walter | |

(Continued)

FOREIGN PATENT DOCUMENTS

EP 0 088 185 A1 9/1983

(Continued)

OTHER PUBLICATIONS

Amtsblatt des Kantons Graubünden, "Hinged, resealable closures for metal can ends," 1996, 2746-2747.

(Continued)

*Primary Examiner* — Anthony Stashick
*Assistant Examiner* — Jeffrey Allen
(74) *Attorney, Agent, or Firm* — Woodcock Washburn LLP

(57) ABSTRACT

A plastic resealable closure includes a base plate affixed to a can, a middle plate having a plug, and a top plate having a support ring. The support ring expands or supports the plug to enhance sealing. The top plate includes prongs that are insertable into recesses on the base plate to enhance closing. The closure is applied without heating of the tool or the closure.

35 Claims, 21 Drawing Sheets

U.S. PATENT DOCUMENTS

| | | | | | |
|---|---|---|---|---|---|
| 4,431,110 | A | | 2/1984 | Roth | |
| 4,440,310 | A | | 4/1984 | Heyn | |
| 4,462,504 | A | * | 7/1984 | Roth et al. | 220/214 |
| 4,540,611 | A | | 9/1985 | Henderson | |
| 4,576,306 | A | | 3/1986 | Kelsey et al. | |
| 4,681,238 | A | | 7/1987 | Sanchez | |
| 4,746,032 | A | | 5/1988 | Huang | |
| 4,821,912 | A | | 4/1989 | Wells | |
| 4,915,290 | A | | 4/1990 | Robichaud et al. | |
| 4,930,654 | A | | 6/1990 | Thibeault et al. | |
| 4,951,835 | A | | 8/1990 | DeMars et al. | |
| 5,085,338 | A | | 2/1992 | Inagaki | |
| 5,148,935 | A | | 9/1992 | Lyon | |
| 5,199,591 | A | | 4/1993 | Thibeault et al. | |
| 5,199,618 | A | | 4/1993 | Reil et al. | 222/541 |
| 5,242,073 | A | | 9/1993 | Willis et al. | |
| 5,335,808 | A | | 8/1994 | Lee | |
| 5,351,853 | A | | 10/1994 | Shock | |
| 5,622,273 | A | | 4/1997 | Kelly | 215/237 |
| 5,692,633 | A | | 12/1997 | Gordon | |
| 5,711,447 | A | | 1/1998 | Plester | |
| 5,813,561 | A | | 9/1998 | Chang et al. | |
| 5,829,610 | A | * | 11/1998 | Rohr et al. | 215/250 |
| 5,947,317 | A | | 9/1999 | Hall | |
| 6,065,634 | A | | 5/2000 | Brifcani et al. | |
| 6,105,806 | A | | 8/2000 | Stasiuk | |
| 6,581,264 | B2 | | 6/2003 | Ohori et al. | |
| 6,588,617 | B1 | | 7/2003 | Majcen et al. | |
| 6,763,963 | B1 | | 7/2004 | Martin | |
| 7,152,766 | B1 | | 12/2006 | Walsh et al. | |
| 7,168,586 | B2 | | 1/2007 | Jeon | |
| 7,198,168 | B2 | | 4/2007 | Mizuma | |
| 2002/0050493 | A1 | | 5/2002 | Ball et al. | |
| 2003/0062370 | A1 | | 4/2003 | Ball et al. | |
| 2003/0178433 | A1 | | 9/2003 | Adams | |
| 2005/0051553 | A1 | | 3/2005 | Li et al. | |
| 2005/0115977 | A1 | | 6/2005 | Dibdin et al. | |
| 2005/0150889 | A1 | | 7/2005 | Perra | |
| 2005/0173453 | A1 | | 8/2005 | Azodi | |
| 2006/0163253 | A1 | | 7/2006 | Steadman | |
| 2007/0068943 | A1 | | 3/2007 | Ramsey | |
| 2007/0145055 | A1 | | 6/2007 | Gardiner | |
| 2007/0164026 | A1 | | 7/2007 | Morrissey | |
| 2007/0215620 | A1 | | 9/2007 | Kasper | |
| 2007/0262079 | A1 | | 11/2007 | Paris | |
| 2008/0053997 | A1 | | 3/2008 | Perra | |
| 2008/0314904 | A1 | | 12/2008 | Perra | |
| 2009/0173737 | A1 | | 7/2009 | Ramsey | |
| 2009/0179033 | A1 | | 7/2009 | Ramsey | |

FOREIGN PATENT DOCUMENTS

| | | | |
|---|---|---|---|
| EP | 0305598 | A1 | 3/1989 |
| EP | 0828663 | B1 | 12/1999 |
| EP | 1767464 | | 3/2007 |
| FR | 1434827 | A | 6/1966 |
| GB | 2154561 | A | 9/1985 |
| GB | 2320008 | A | 6/1998 |
| JP | 61-48128 | | 5/1994 |
| JP | 2003-054549 | | 2/2003 |
| JP | 2003-112735 | | 4/2003 |
| KR | 2000-17742 | A | 4/2000 |
| WO | WO 91/10600 | | 7/1991 |
| WO | WO 95/04709 | | 2/1995 |
| WO | WO 96/09968 | | 4/1996 |
| WO | WO 98/36987 | | 8/1998 |
| WO | 01/28875 | A1 | 4/2001 |
| WO | WO 02/00512 | | 1/2002 |
| WO | WO 03/062084 | | 1/2003 |
| WO | 2007/039367 | A1 | 4/2007 |
| WO | WO 2007/128810 | | 11/2007 |
| WO | WO 2008/054636 | | 5/2008 |
| WO | WO 2008/068169 | | 6/2008 |
| WO | WO 2009/062004 | | 5/2009 |

OTHER PUBLICATIONS

U.S. Appl. No. 12/470,909, filed May 22, 2009, Ramsey.
U.S. Appl. No. 11/747,049: Non-Final Rejection, Sep. 15, 2009.
English Translation of Abstract of JP 2003-112735, published on Apr. 18, 2003.
English Translation of Abstract of JP 2003-054549, published on Feb. 26, 2003.
English Translation of Abstract of JP 61-48128, published on May 27, 1994.
U.S. Appl. No. 11/503,087: Response to Final Rejection and Request for Contined Examination, Feb. 2, 2010.
U.S. Appl. No. 11/503,087: Final Rejection, Nov. 2, 2009.
U.S. Appl. No. 11/503,087: Amendment / Request for Reconsideration After Non-Final Rejection, Jun. 22, 2009.
U.S. Appl. No. 11/503,087: Non-Final Rejection, Jan. 22, 2009.
U.S. Appl. No. 12/447,576, filed Apr. 28, 2009.
U.S. Appl. No. 11/503,087: Non-Final Rejection dated Nov. 7, 2011, 21 pages.

* cited by examiner

RESEALABLE CLOSURE

BACKGROUND

The present invention relates to a package having a sealing device, and more particularly to resealable closure for a metal beverage container.

Beverage containers typically comprise a metal can body which is closed by means of an easy open can end. Such ends are generally opened by raising a metal tab, the nose of which presses onto a scored panel, which is thus forced open to provide a pouring aperture. Such easy open ends are, however, not re-sealable.

Hinged, resealable closures for metal can ends are shown in pages 2746-2747 of the Amtsblatt des Kantons Graubünden, published on 13th Sep., 1996, and in U.S. Pat. Nos. 4,369,888; 5,622,273; 4,361,244; and 5,199,618. None of these closures have achieved significant commercial success. There is a need for improved resealable closures that can easily be opened and resealed.

SUMMARY

A can end combination includes a metal can end and resealable closure coupled to the can end. The can end includes a peripheral wall and a center panel having an upper surface, an opposing lower surface, and an aperture formed therethrough. The closure includes a base plate that is coupled to the can end center panel and includes a recess formed therein and an opening formed therein; a middle plate that includes a plug and is connected to the base plate by a first hinge; and a top plate that includes at least one prong and is connected to the middle plate by a second hinge. At least one of the can end aperture and the closure base plate form a pour opening.

The closure has (i) a fully closed position in which the base plate, middle plate, and top plate are in mutually contact, the plug is located in the pour opening to obstruct the pour opening, and the at least one prong of the top plate is located in the recess of the base plate, (ii) a intermediate position in which at least the top plate is in an oblique position relative to horizontal, (iii) a fully open position in which the plug is spaced apart from the pour opening and the prong is spaced apart from the recess, and (iv) a reclosed position that is enabled after initial opening and in which the plug is located in the pour opening to obstruct the pour opening, and the at least one prong is located in the recess. The prong enhances the opening and closing processes of the closure.

In a first embodiment, an extension of the closure base plate extends through the aperture in the end and includes a hoop having a sidewall that defines the pour opening, and the plug is located in the pour opening when the closure is in its fully closed position. In a second embodiment, the base plate includes a rim at a periphery of the opening, and the can end includes a curl that extends over at least a portion of the inner periphery. The curl defines the pour opening such that the plastic plug contacts the metal curl when the closure is in its fully closed position. The plastic to metal contact that forms the seal may diminish the effect of the reweld location of the base plate.

Preferably, the plug has a sidewall having a bead capable of contacting the curl when the closure is in its fully closed position. Preferably, the plug panel includes a ramp, and a portion of a rim of the ring of the top plate contacts the ramp to enhance insertion of the plug into the pour opening while the closure is moved toward the reclosed position.

Preferably, the base plate includes an overhang that forms the recess, and the at least one prong contacts a bottom surface of the recess as the top plate is moved from its fully closed position to its intermediate position. Preferably, the bottom surface of the recess is formed by the upper surface of the can end center panel. The at least one prong preferably is a pair of prongs at a foot of the top plate and the recess is a pair of recess formed at a rear of the base plate. Distal tips of the prongs slide on the upper surface of the end while the top plate moves from its fully closed position to the intermediate position. The top plate pivots and upwardly translates while the top plate moves from its fully closed position to the intermediate position such that the movement of the top plate toward the intermediate position lifts at least a portion of the plug from the pour opening. Preferably, the at least one prong is inserted into the recess and an upper surface of the prong contacts the underside surface of the recess during the closing process to the reclosed position.

Preferably, the top plate includes a ring extending downwardly from an underside thereof, and the ring contacts an inside surface of the plug while the closure is in the fully closed position. The plug includes a plug panel and a peripheral sidewall, and the plug panel has a radial thickness that is greater than a radial thickness of the plug sidewall. Also, the plug sidewall has an outside diameter that is less than an inner diameter of the pour opening. The top plate includes a ring extending downwardly from an underside thereof. The ring has an outside diameter that is greater than an inside diameter of the plug sidewall, and the ring has a radial thickness that is greater than the radial thickness of the plug sidewall. The ring extends into the plug while the closure in its fully closed position such that an outside surface of the ring urges the plug sidewall radially outwardly into contact with the pour opening sidewall.

Preferably, the middle plate includes a vent hole and the top plate includes a vent hole stopper that is located in the vent hole to seal the vent hole while the closure is in its fully closed position. The ring includes vents formed therein for enabling communication across the ring for releasing pressure upon release of the vent hold stopper from the vent hole.

The prongs may contact a seam that couples the can end to the can body such that the top plate and middle plate are releasably retained and spaced apart from the pour opening. Or a foot of the top plate may contact a seam that couples the can end to the can body such that the top plate and middle plate are releasably retained and spaced apart from the pour opening.

The closure has features that exploit a cold deformation process. In this regard, in the first embodiment, the base plate includes a downwardly extending hoop that extends through the aperture in the can end center panel. The hoop has a bottom flange that extends radially outwardly to clamp the base plate to the can end center panel. The bottom surface of the flange has alternating peaks and valley formed therein during application of the closure to the can end, whereby clamping is enhanced. The peaks and valleys encompass any relatively high portions adjacent relatively low portions.

The base plate includes an upwardly protruding stake (protruding from the base plate) that engages the top plate while the closure is in the fully closed position. The stake becomes disengaged from the top plate upon moving the top plate from the fully closed position toward the intermediate position, thereby providing tamper evidence. The stake preferably includes a rivet head that protrudes through an aperture in the top plate to engage the top plate. The aperture may include a countersink in which the rivet head is disposed while the closure is in its fully closed position. In a first embodiment, the rivet head is pulled through the aperture upon moving the closure from its fully closed position toward its intermediate position. The rivet head is not insertable back into the countersink after initial opening of the closure such that the head is not located in the countersink while the closure is in the reclosed position. Alternative to the first embodiment tamper evident feature above, the top plate may include a web in which at least a part of the aperture is formed. A rivet head is located in or above the web while the closure is in its fully closed position, such that the web is ruptured upon moving the closure from its fully closed position toward its intermediate position.

An injection mold having a cavity for forming the closure describe above is also provided.

According to another aspect of the invention, a closure includes an unapplied state and an applied state in which the closure is applied to an aperture in a center panel of a metal can end. The closure in its unapplied state comprises: a base plate including an opening sidewall forming an aperture therein; a middle plate including a plug and connected to the base plate by a first hinge; a top plate connected to the middle plate by a second hinge; and a stake protruding upwardly from the base plate through an aperture in the top plate. The stake in its unapplied state has a hollow distal portion. In its initially applied state, the stake distal portion is deformed into a rivet-shaped head that is located over a portion of the top plate, and the base plate, the middle plate, and the top plate are in mutual contact.

According to another aspect of the invention, a method for applying a resealable closure to a metal can end comprises the steps of: providing a resealable closure (described below); providing a metal can end including a center panel having an aperture formed therein and a curl located at the periphery of the aperture; placing the closure onto an upper surface of the metal end such that the base plate hoop extends through the can end aperture; providing a cool deforming tool that includes alternating peaks and valleys; and contacting the tool against a lower portion of the hoop in a cool state to deform a portion of the hoop in a peaks and valley pattern, whereby the closure is clamped onto the can end. The closure includes a base plate including a hoop that forms an opening; a middle plate including a plug and connected to the base plate by a first hinge; a top plate connected to the middle plate by a second hinge; and a stake protruding upwardly from the base plate through an aperture in the top plate. Preferably, the curl directly extends from a substantially horizontal portion of a center panel of the can end, and the contacting step includes forming a recess in which the curl is at least partially located.

According to another aspect of the invention, a method for making a resealable can end comprises the steps of: providing a closure that includes a base plate including a rim that defines an opening therein, a middle plate including a plug and connected to the base plate by a first hinge, and a top plate connected to the middle plate by a second hinge; providing a metal can end including a peripheral curl and center panel having an aperture that is defined by an edge; locating the can end relative to the closure; and forming the can end edge into a curl that grips the base plate rim to secure the can end and closure together. Preferably, the step of providing a metal can end includes pressing the edge into an upstanding position, and the step of forming the can end edge includes crimping the upstanding edge downwardly and radially outwardly over the closure rim.

According to another aspect of the present invention, a method of forming a tamper-evidence feature on a closure comprises the steps of: providing a closure that includes a base plate including an opening sidewall forming a pour opening, a middle plate including a plug and connected to the base plate by a first hinge, a top plate having an aperture and connected to the middle plate by a second hinge; and a stake protruding upwardly from the base plate. The stake has a hollow distal tip. Then, the method includes positioning the top plate relative to the base plate such that the stake protrudes through at least a portion of an aperture; providing a cool deforming tool; and contacting the tool against the stake tip and deforming the tip into a rivet-shape head while the stake is cool, whereby the stake head is located over a portion of the top plate while the closure is in its initial fully closed position. The step of providing the closure includes providing a top plate having a top plate panel, a tab, and a hinge coupling the panel and the tab. The aperture is formed in the tab such that the head is capable of being pulled through the aperture upon initial opening. The tamper evident features may be as described above.

According to another aspect of the invention, a method of applying a resealable closure to a metal can end comprises the steps of: providing a closure that includes a base plate including a hoop that forms an opening, a middle plate including a plug and connected to the base plate by a first hinge, a top plate connected to the middle plate by a second hinge, and a stake protruding upwardly from the base plate through an aperture in the top plate; providing a metal can end including a center panel having an aperture formed therein and a curl located at the periphery of the aperture; placing the closure onto an upper surface of the metal end such that the base plate hoop extends through the can end aperture; providing a cool deforming tool that includes alternating peaks and valleys; and contacting the tool against a lower portion of the hoop in a cool state to deform a portion of the hoop in a peaks and valley pattern, whereby the closure is clamped onto the can end. Preferably, the curl directly extends from a substantially horizontal portion of a center panel of the can end, and the contacting step includes forming a recess in which the curl is at least partially located.

The combination includes various features that enhance the resealability, easy of use, manufacturing, and the like. The present invention, however, is not limited to any configuration having any particular advantages or to any configuration or function identified as an aspect of the invention.

DETAILED DESCRIPTION OF PREFERRED EMBODIMENTS

Figure 1:
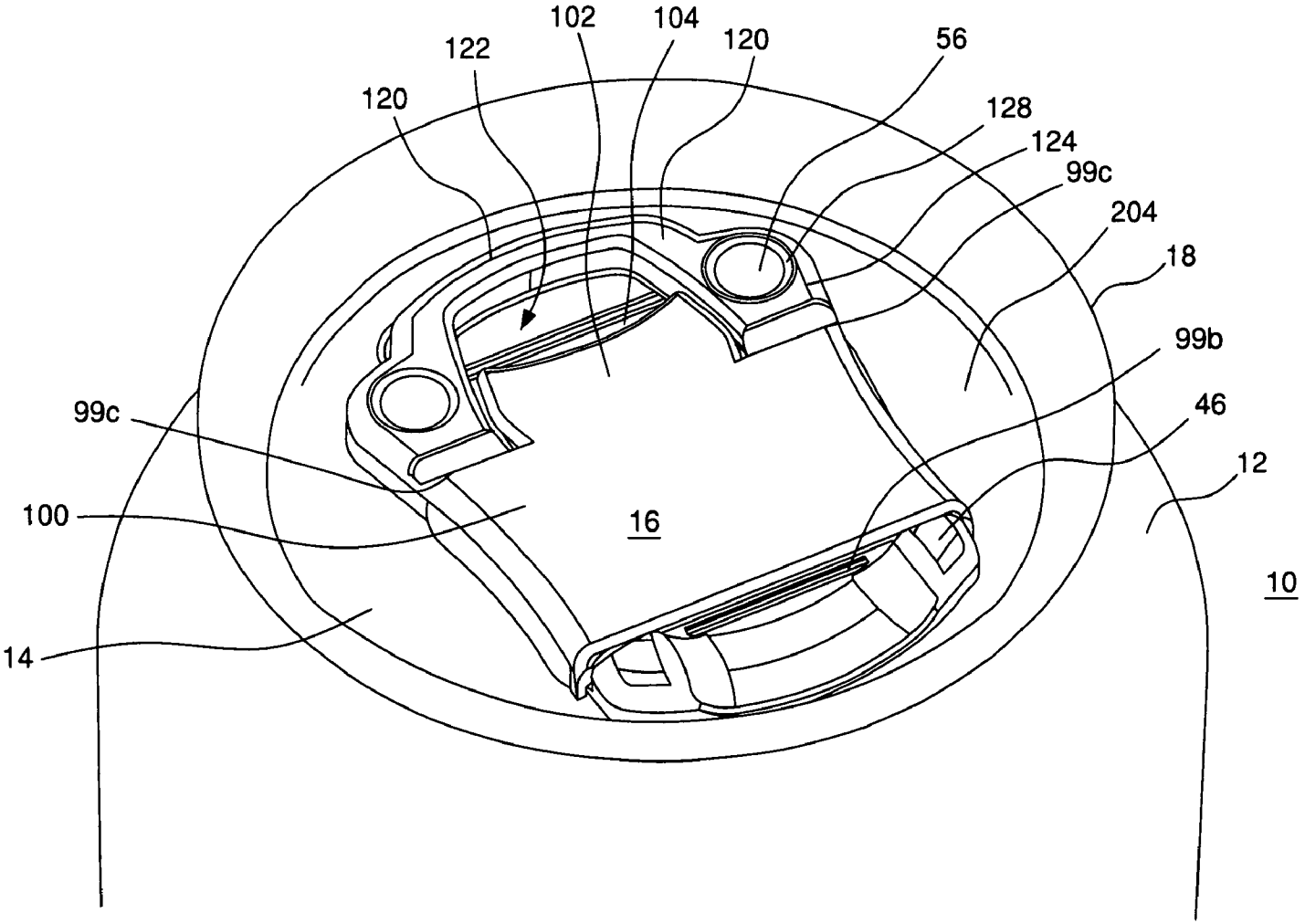
FIG. 1 is a perspective view of the package illustrating a first embodiment of the closure in its fully closed position.

A package 10 includes a can body 12, a can end 14, and a closure 16. Preferably, can body 12 is a conventional metal can used for carbonated or non-carbonated beverages and includes a seam 18 joining can body 12 to end 14.

Figure 6A:
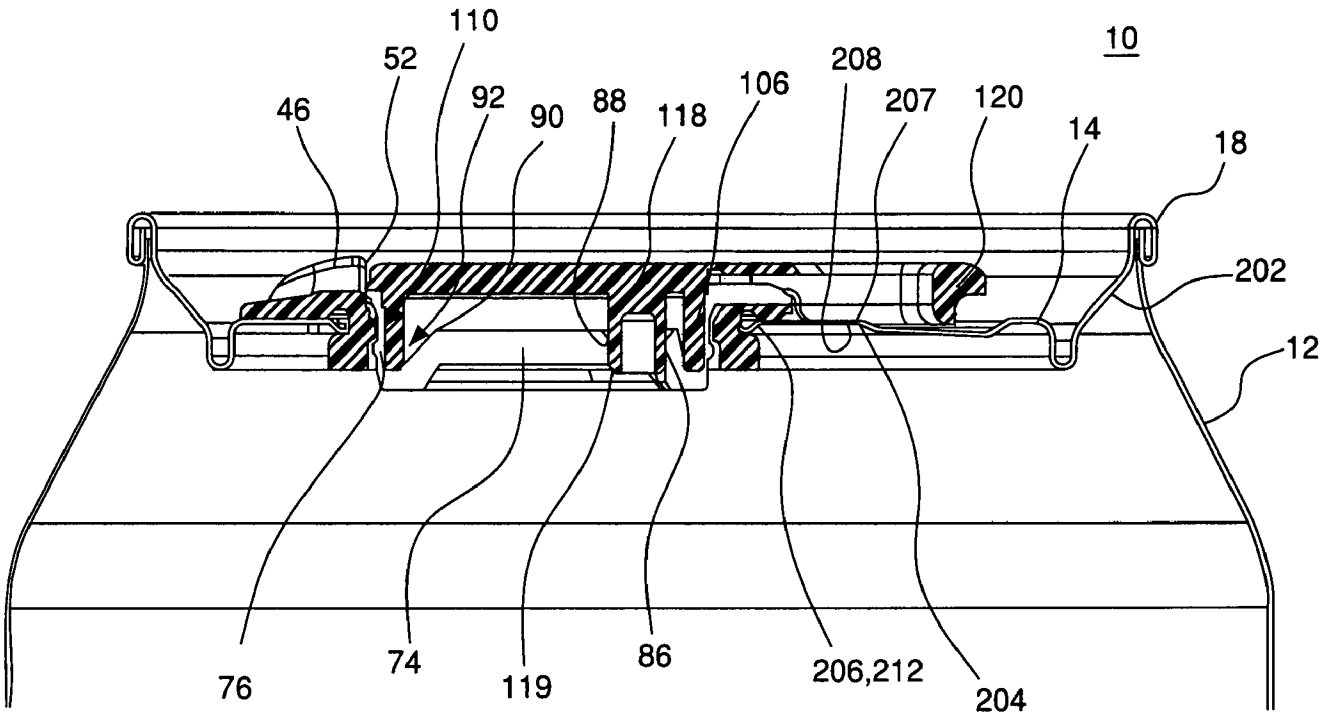
FIG. 6A is a cross sectional view of the package of FIG. 1 illustrating the closure in its fully closed position.
Figure 6B:
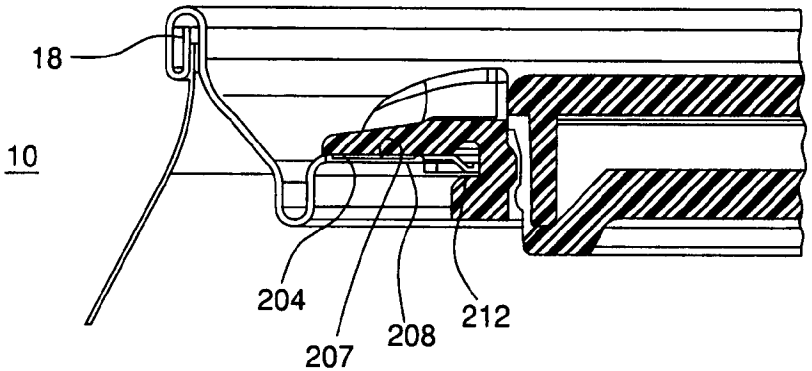
FIG. 6B is an enlarged view of a portion of the package shown in FIG. 6A.

As shown for example in FIG. 6A and FIG. 6B, can end 14 includes a peripheral wall 202 that extends into seam 18, a center panel 204, and an aperture 206 formed in the center panel. Can end 14 is shown only in its seamed state; it will be clear to persons familiar with can end configurations that can 14 in its unseamed state will include a peripheral curl, such as that disclosed in United States Patent Number (BRIFCANI), which is incorporated herein in its entirety. Center panel 204 includes an upper surface 207 and a lower surface 208. A curl 212 is formed about the inner periphery of aperture 206. Preferably, curl 212 extends directly from a planar and horizontal portion of center panel 204 without a raised or vertical wall section (in transverse cross section). The present invention, however, encompasses can ends of any configuration, including for example can ends having a spout portion on which the curl is formed, ends that form a dome shape, and other configurations. Accordingly, the term "center panel" as used herein is not limited to flat or planar surfaces of a conventional beverage can ends.

As shown in FIGS. 1 through 12, closure 16 is formed of a single plastic piece having including a base plate 20, a middle plate 70, and a top plate 100. A first hinge 99*a* connects base plate 20 to middle plate 70 and a second hinge 99*b* connected middle plate 70 to top plate 100.

Figure 9B:
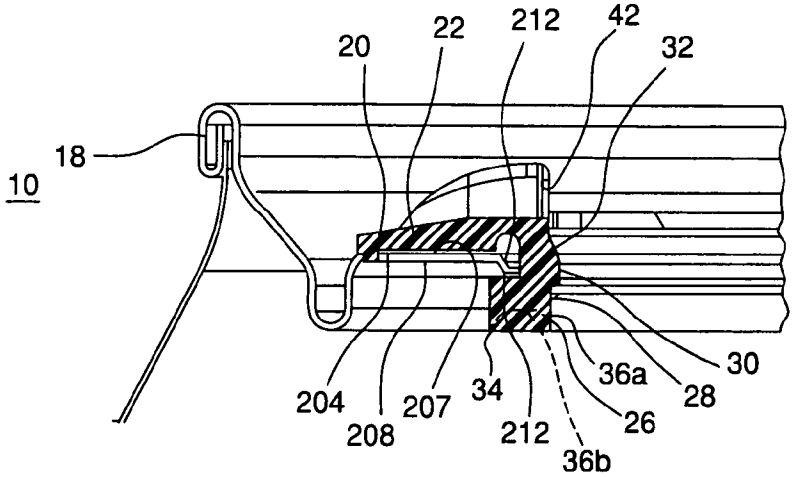
FIG. 9B is an enlarged view of a portion of the package shown in FIG. 9A.
Figure 9A:
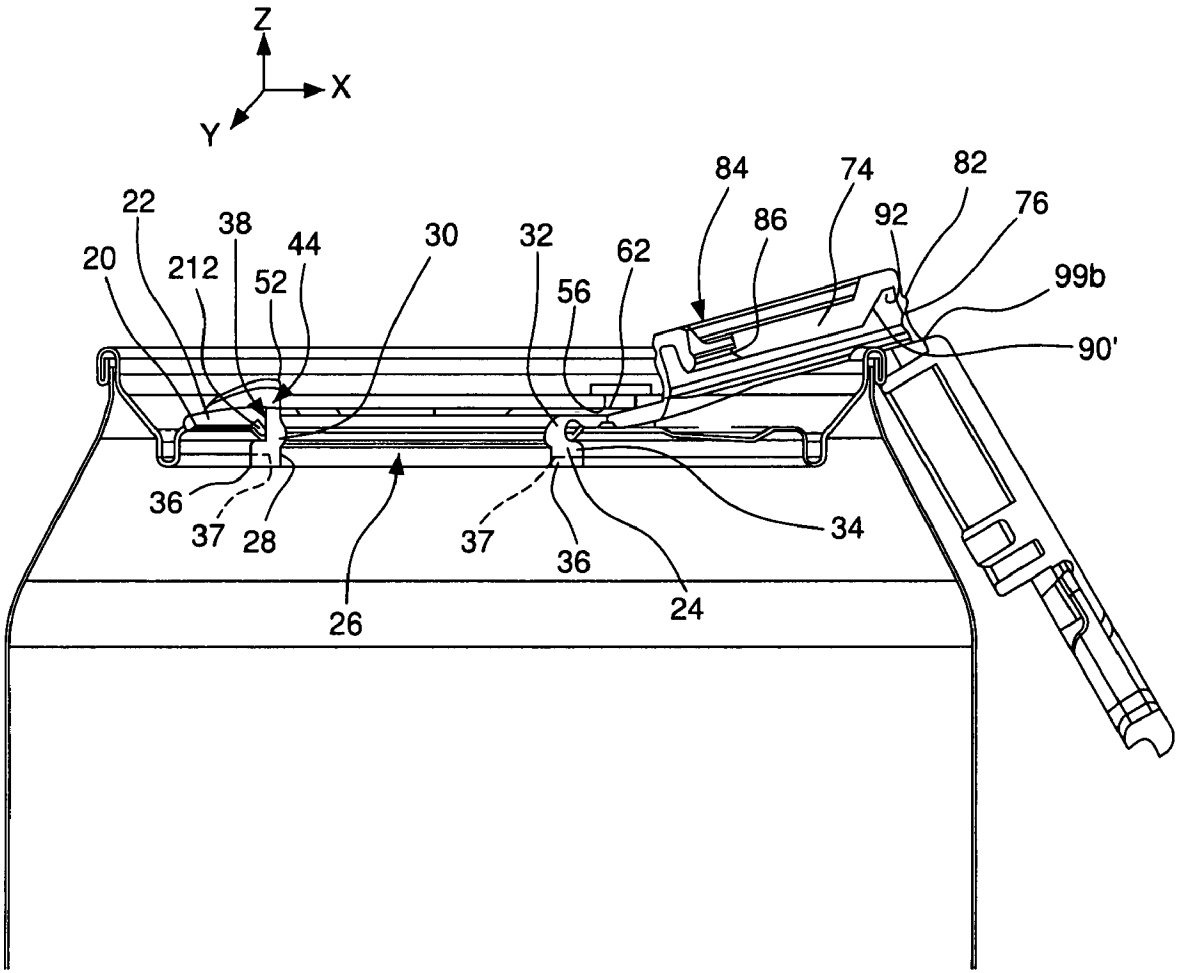
FIG. 9A is a cross sectional view of the package of FIG. 1 illustrating the closure in its fully open position.

Base plate 20 includes top portion 22 and a downwardly descending hoop 24 that forms a pour opening 26, as best illustrated by FIGS. 9A and 9B. Hoop 24 includes an inner sidewall 28 having a circumferential sealing rim 30 formed in it. A circumferential taper 32 is formed on an upper portion of inner sidewall 28.

On the underside of base plate 20, hoop 24 includes an outwardly extending flange 34 that is formed by deforming hoop 24 such that flange 34 clamps against an underside of curl 212. Preferably, hoop 24 and sealing rim 30 form a radially outwardly facing recess 38 for receiving curl 212.

As illustrated by dashed lines in FIG. 9A and FIG. 9B, hoop 24 has alternating peaks 36 and valleys 37 pressed into underside (downwardly facing) face, which result from the process of applying closure 16 to can end 14. The terms "peaks" and "valleys" as used herein are intended to encompass any shape of portions that are recessed relative to nearby portions.

A pair of opposing recesses 44 are formed in upper portion 22 at the rear of base 20. Each recess 44 preferably is formed by an overhang 46 that has a front-facing opening. Preferably, recess 44 is formed by a floor 48, which preferably is the upper surface 42 (FIG. 9B) of the panel of end 14, and an underside 50 of overhang 46. The front edge of overhang 46 forms a front lip or front face 52.

A pair of opposing, approximately planar wings or extensions 54 extend opposite recesses 44. A stake 56 extends upwardly from each extension 54. Preferably, each stake includes a rivet-like head 62.

Middle plate 70 includes a plug 72 from which a flange 73 extends. Flange 73 is connected to base plate 20 by hinge 99*a*. Plug 72 includes a plug panel 74 that is approximately circular, and a peripheral plug sidewall 76 that extends upwardly from plug panel 74. Panel 74 is raised relative to the bottom end of sidewall 76 such that a circumferential groove 92 extends around panel 74.

Figure 7:
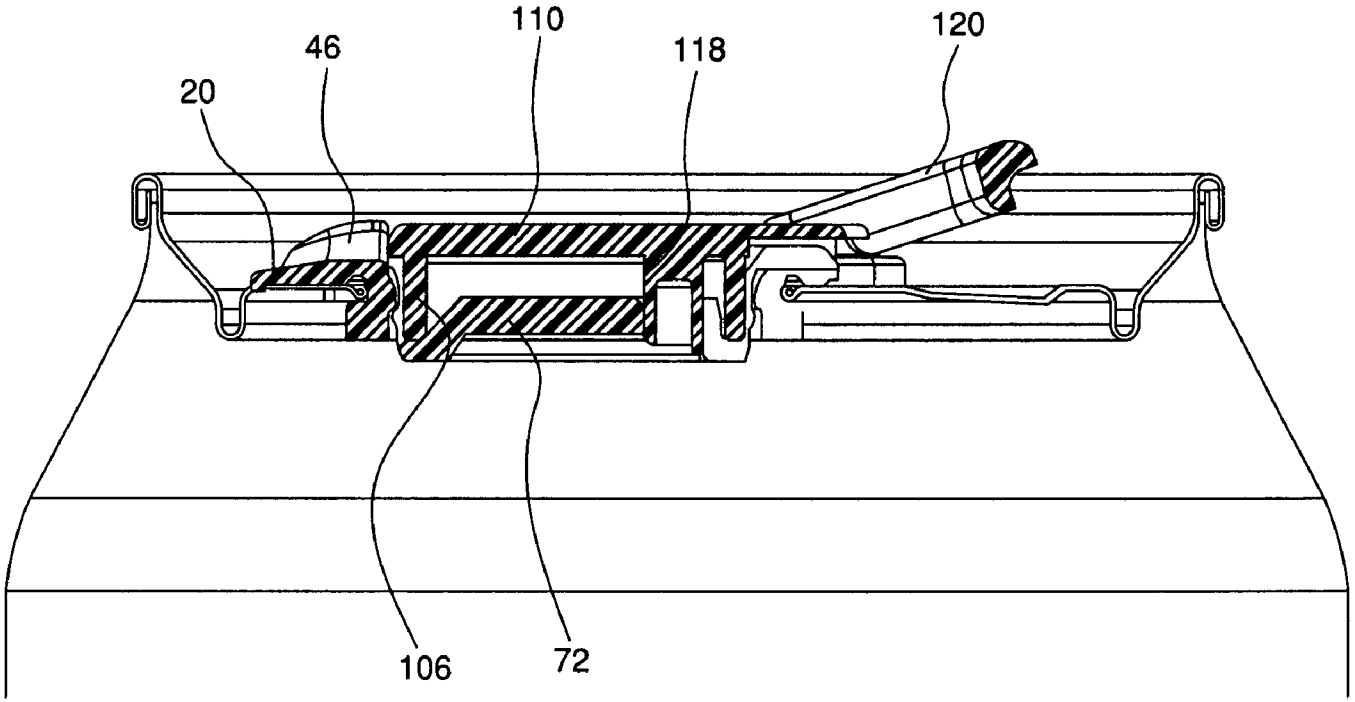
FIG. 7 is a cross sectional view of the package of FIG. 1 illustrating the closure in its first stage of the opening process.
Figure 8A:
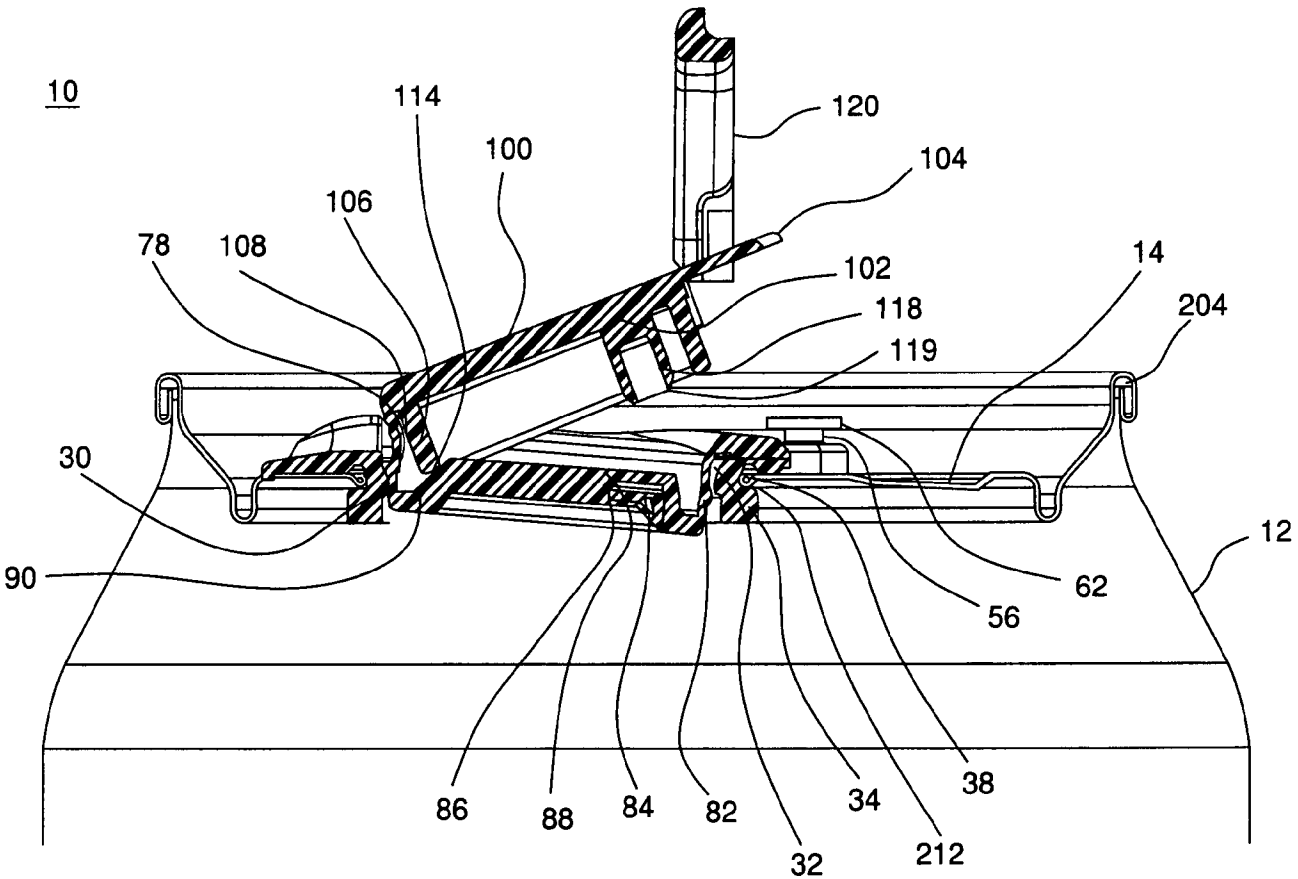
FIG. 8A is a cross sectional view of the package of FIG. 1 illustrating the closure in its second stage of the opening process.
Figure 8B:
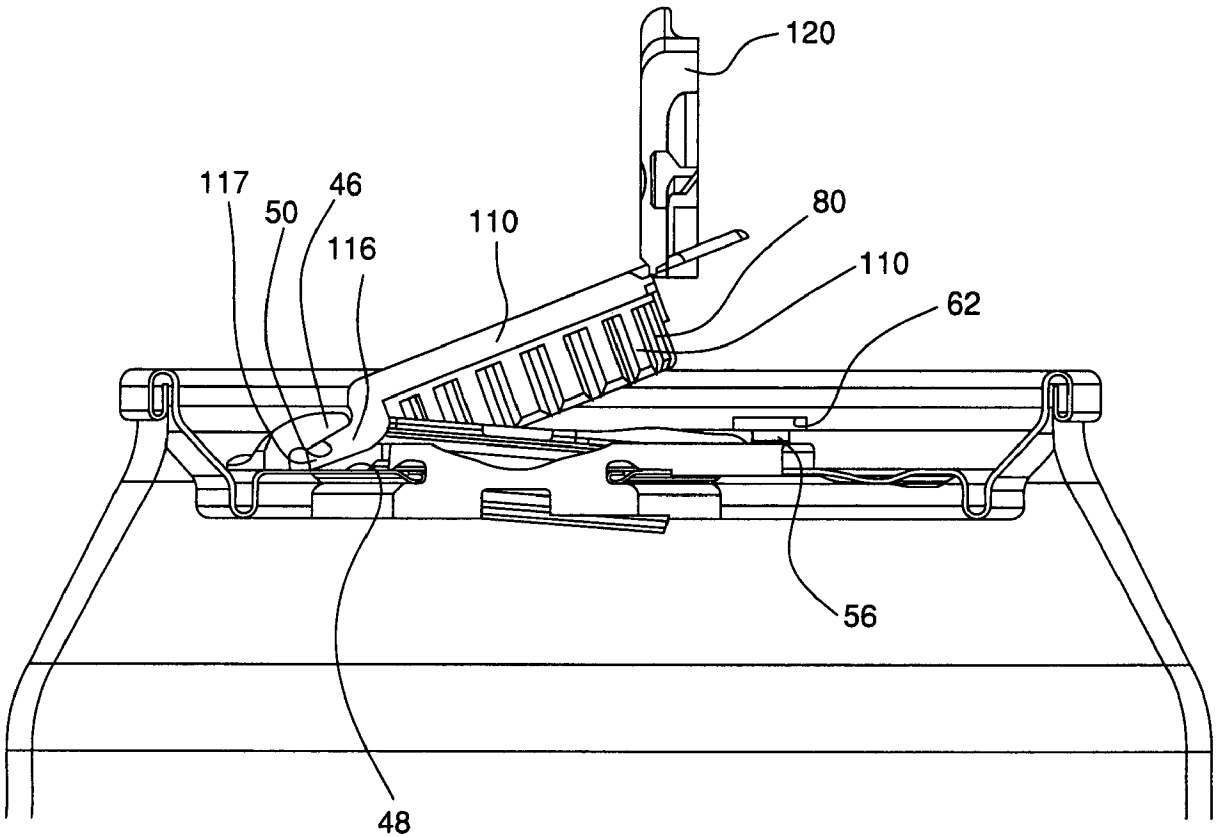
FIG. 8B is a partial cross sectional view of the package shown in FIG. 8A.

A rear portion of plug panel 74 has is an incline or ramp 90 that is inclined relative to the relatively horizontal portion (that is, as oriented in the closure's fully closed position) of panel 74. As best shown in FIGS. 6A, 7, and 8A, ramp 90 slopes downwardly from panel 74 toward the rear portion of plug 72. Preferably, ramp 90 is straight in transverse cross section, and the present invention encompasses ramps of any configuration, including curved or stepped ramps (not shown in the figures).

Plug sidewall has an inner surface 78 and an outer surface 80, which preferably includes a circumferential rib 82 that protrudes from the surface of outer surface 80. A vent hole 84 preferably is formed through plug panel 74. Preferably, vent hole 84 has circular cross section and is defined by a sealing surface 84 that has a bead or rib 88 about its inner circumference. Preferably, the thickness of sidewall 76 is significantly less than the thickness of panel 74 to enable plug 72 to deform, as explained more fully below.

Top plate 100, which is connected to middle plate 70 by a hinge 99*b*, includes a top panel 102 having a lip or edge 104 at a front portion thereof. A circular support ring 106 extends downwardly from the underside of panel 102, and a cylindrical stopper 118 extends downwardly from the underside of panel 102 within the circumference of ring 106. Ring 106 preferably is circular and sized to fit within groove 92 about the periphery of plug panel 74. Preferably, ring 106 terminates in a rim 114 that is circular and parallel to top plane panel 102. An outer surface 108 of ring 106 includes channels 110. Stopper 118 has a tapered tip 119.

A tab 120 extends from the front edge 104 of top plate 100. Tab 120 is connected to top plate 100 by a pair of opposing hinges 99*c*. A hollow or cutout 122 is formed between the body of tab 120 and top plate front edge 104. A pair of wings 124 extend outwardly from the body of tab 120. Each wing 124 includes an aperture 126 having a contact surface 128 for receiving stake head 62. Preferably, and as best shown in FIG. 10, contact surface 128 has the shape of a frustum of a cone and is formed by sidewalls that are thinner than the stake base (and preferably thinner than the thickness of plate panel 102) to enable contact surface 128 to aid in the opening process.

A pair of prongs 115 extends from the rear of top plate panel 102. Each prong 115 has a body 116 that terminates in a distal tip 117. Body 116 preferably is short protrusion that extends downwardly and outwardly from panel 102, or outwardly from an underside of panel 102. The prongs 115 are spaced apart by nearly the entire width of panel 102. Prongs 115 are sized in cross section to fit into recess 44 formed in the top plate. Each prong 115 has a length (that is, the distance that prong 115 extends from top plate panel 102) such that its distal tip 117 contacts recess floor 48 during the opening process. In this regard, the length of each prong 115 preferably is less than the height of recess 44, which in the embodiment shown may be defined by the distance from recess floor 48 to the underside 50 of overhang 46.

Figure 10:
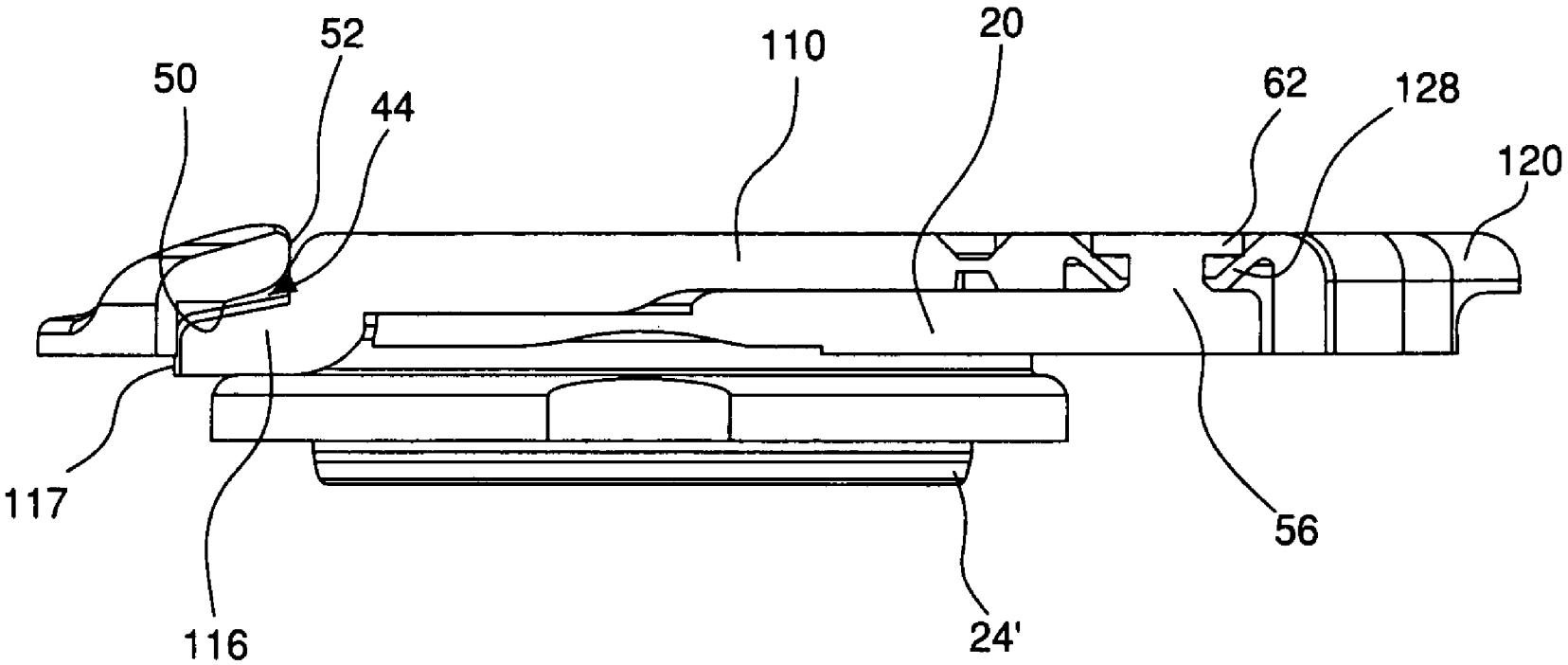
FIG. 10 is a cross sectional view of the closure of the first embodiment shown prior to being applied to a can end.

FIGS. 1, 6A, and 10 illustrate closure 16 applied to can end 14 in its fully closed position, which may be immediately after seaming and before opening by a consumer. In the fully closed position, top plate 100 is in contact with middle plate 70, which is in contact with base plate 20 such that the planar plate surfaces 102, 73, and 22 are approximately parallel with the center panel 204 of can end 14.

Flange 73 of middle plate 70 may contact base plate main portion 22, and plug 72 is located in the pour opening 26 such that outer surface 80 of plug sidewall 76 contacts hoop inner sidewall 28 of base 20. Plug sidewall rib 82 is located beneath sealing rim 30 of base 20. Preferably, the rib 82 is engaged with sealing rim 30 to enhance the seal between plug 72 and hoop inner sidewall 28. Preferably, the diameter of sidewall outer surface 80 is less than the inner diameter of hoop inner sidewall 28.

The support ring 106 of top plate 100 is located in the groove 92 of plug 72. Preferably, the support ring outer surface 108 has a diameter that is larger than the diameter of plug sidewall inner surface 78 such that support ring 106 expands plug 72 against hoop inner sidewall 28 to enhance the seal between the plug and the base. Vent stopper 118 is located in vent hole 84 and in contact with vent hole sealing surface 86. Rib 88 on sealing surface 84 enhances the seal between stopper 118 and sealing surface 86.

Stakes 56 are located within and protrude through holes 126 in tab 120. Heads 62 preferably are in contact with conical surfaces 128 to retain tab 120 in its fully closed position, which is flat against or near base 20 or inline with top plate panel 102.

Prongs 115 are located at least partly in recesses 44. Preferably, a lower surface of each prong 115 is in contact with can end upper surface 207, and an upper surface of each prong is spaced apart from underside 50 of overhang 46 to enable movement of prong 115 within recess 44.

Figure 2:
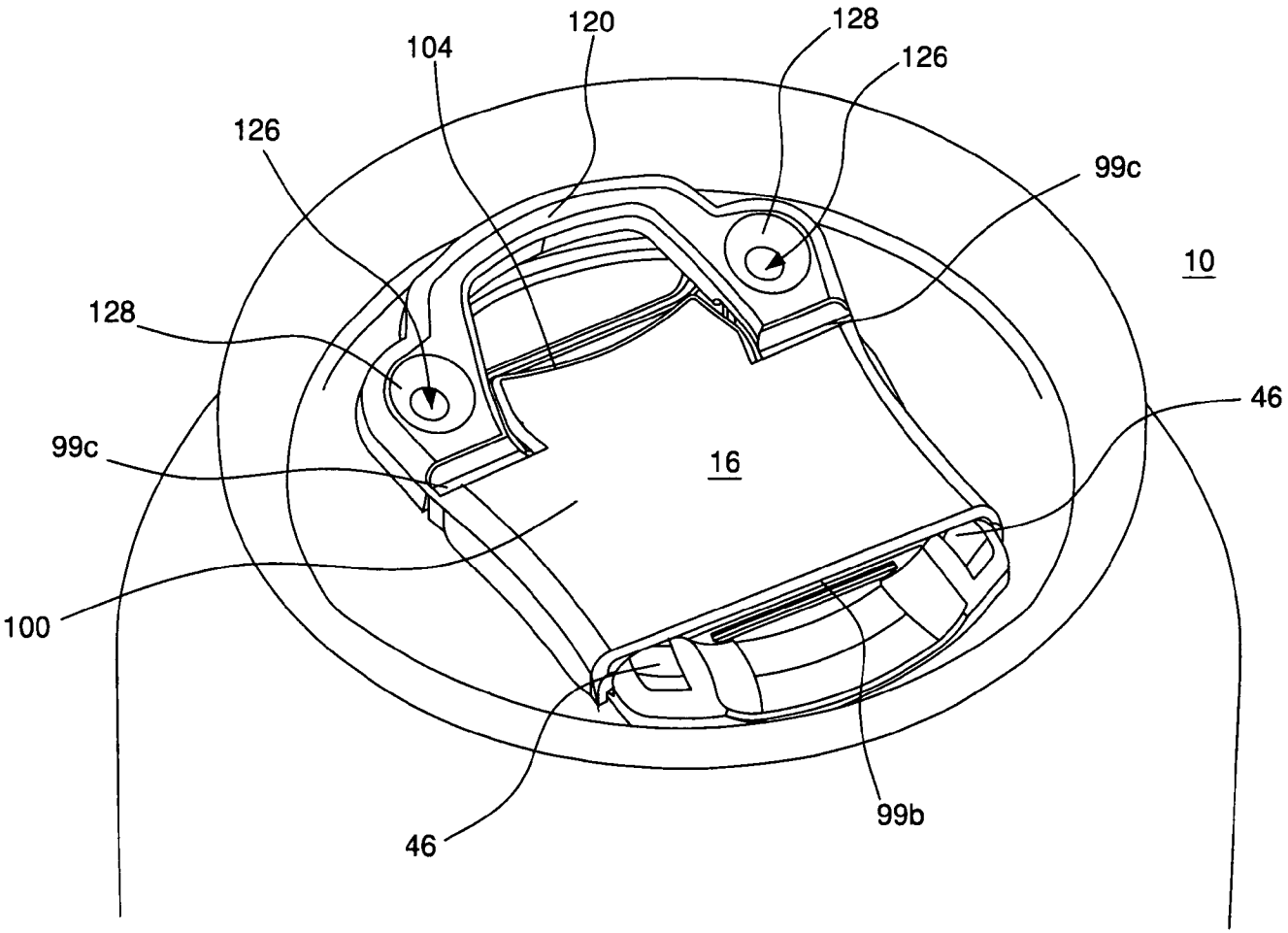
FIG. 2 is a perspective view of the package of FIG. 1 illustrating a first stage of the opening process, and illustrating the reclosed position.
Figure 11:
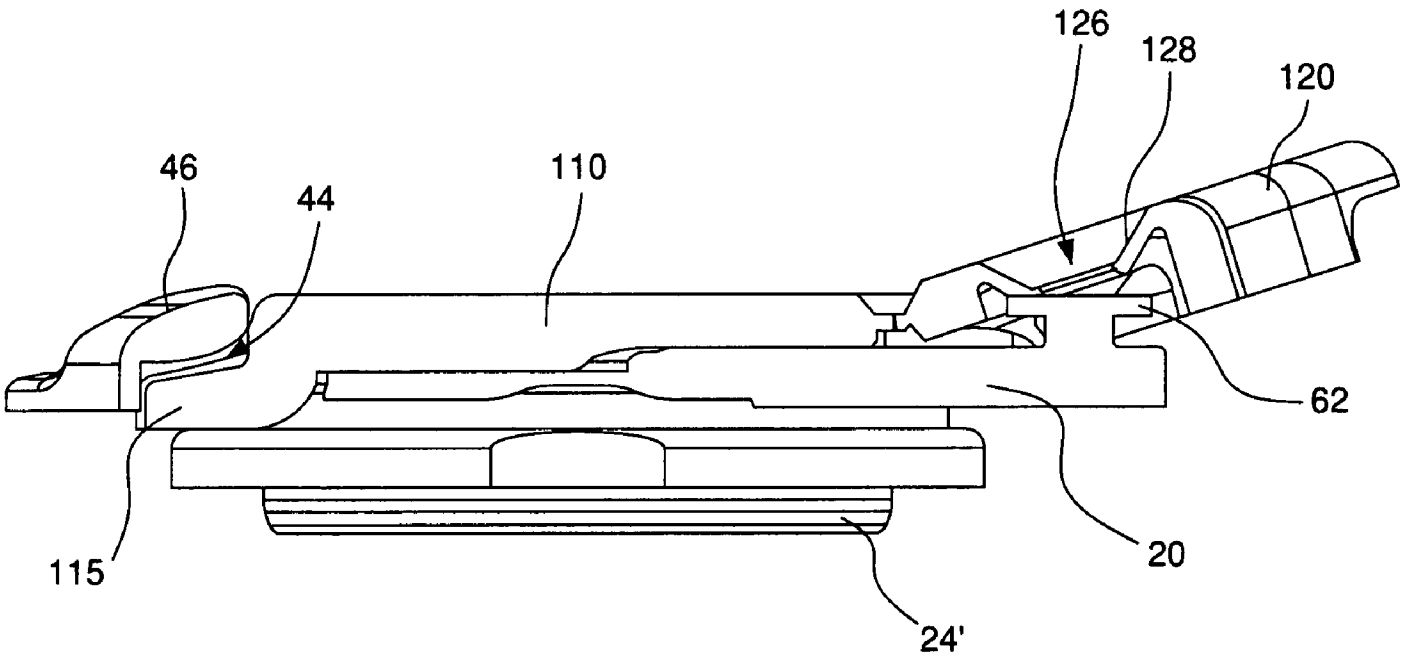
FIG. 11 is a cross sectional view of the closure of FIG. 10 having the tab shown in the first stage of the opening process.

FIGS. 2, 7, and 11 show a first opening position of closure 16, in which tab 120 is pivoted from its fully closed position. To actuate tab 120, a user may place his finger at the front portion of closure 16 and pull upwardly until wings 124 of tab 120 are separated from stakes 56 of base plate 20. To reach the position shown in FIGS. 1, 7, and 11, head 62 of stake 56 must be pulled through hole 126.

Figure 3:
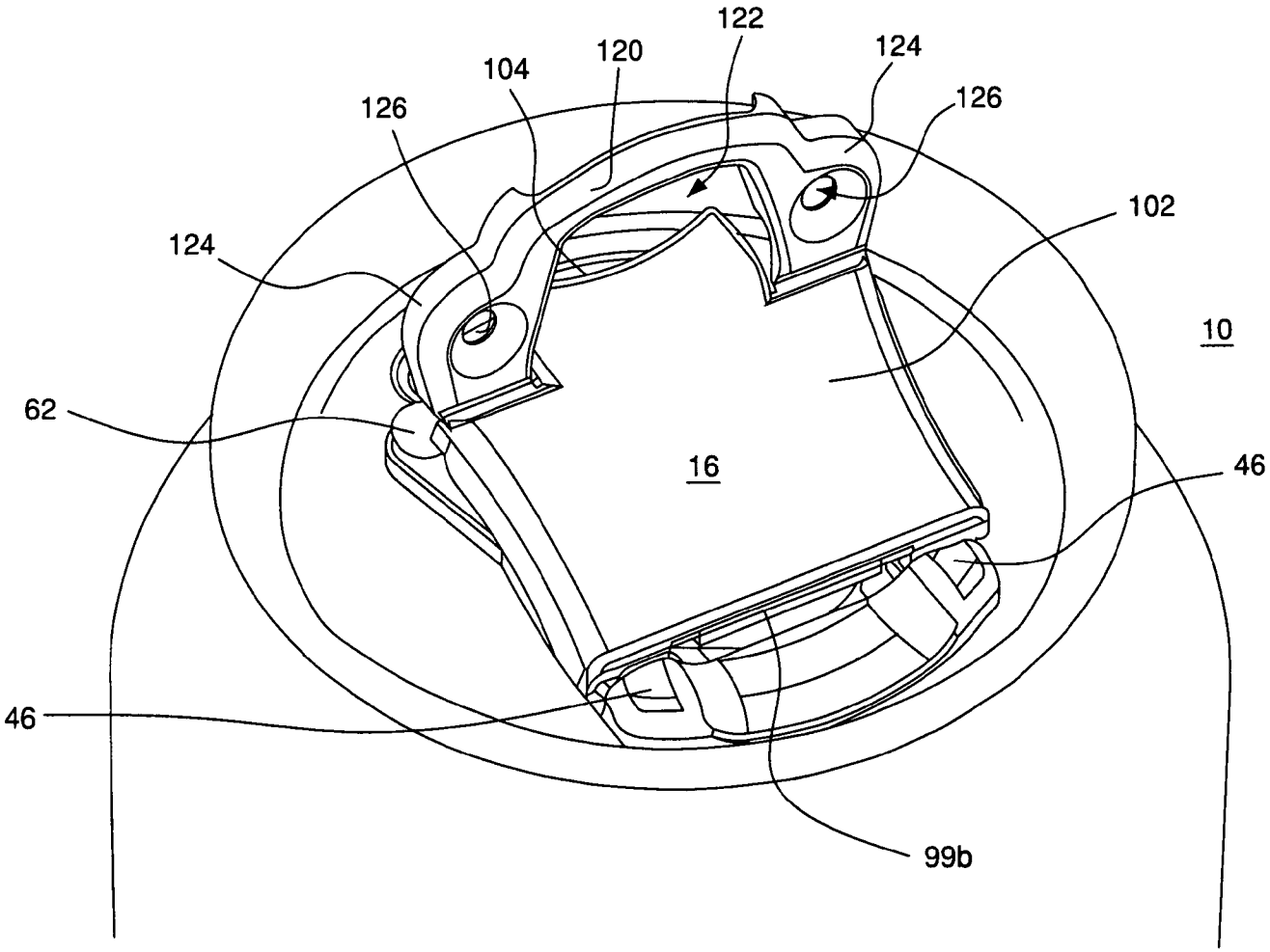
FIG. 3 is a perspective view of the package of FIG. 1 illustrating a second stage of the opening process.

The user may position his finger within cutout 122 or contact edge 104 of top plate 100 to continue the opening process. FIG. 3 shows a second position in which tab 120 is pivoted further relative to top plate 100, and top plate 100 is pivoted such that support ring 106 is disengaged from plug 72 at its front portion. FIG. 3 shows the front portion of lip 114 of ring 106 is spaced apart from plug 72 at the front, and the rear portion of lip 114 sliding over and up ramp 90.

As top plate 100 is moved from its first opening position (FIG. 2 et al.) to its second opening position (FIG. 3 et al.), each prong 115 slides along recess floor 48 as the base of body 116 or adjacent edge of top plate panel 102 contacts the front face 52 of recess overhang 46. Top plate 100 preferably both pivots and translates during this stage of opening. Top plate 100 undergoes pivoting movement about front face 52 while the contact of prongs 115 against recess floor 48 causes top plate 100 to translate. In this regard, prongs 117 pivot as tips 117 slide over recess floor 48, which moves the rear portion of top plate 100 upwards. As best shown in FIG. 8A, the action of top plate 100 raises the rear portion of top plate upwards, which pulls the corresponding portion of middle plate upwards through hinge 99*b*.

As top plate 100 moves from its fully closed position, stopper 118 is pulled from vent hole 84, which releases pressure (if any) from the interior of package 10. Preferably, plug 72 is engaging hoop sidewall 28 at this stage, and the channels 110 provide venting to the atmosphere.

Figure 4:
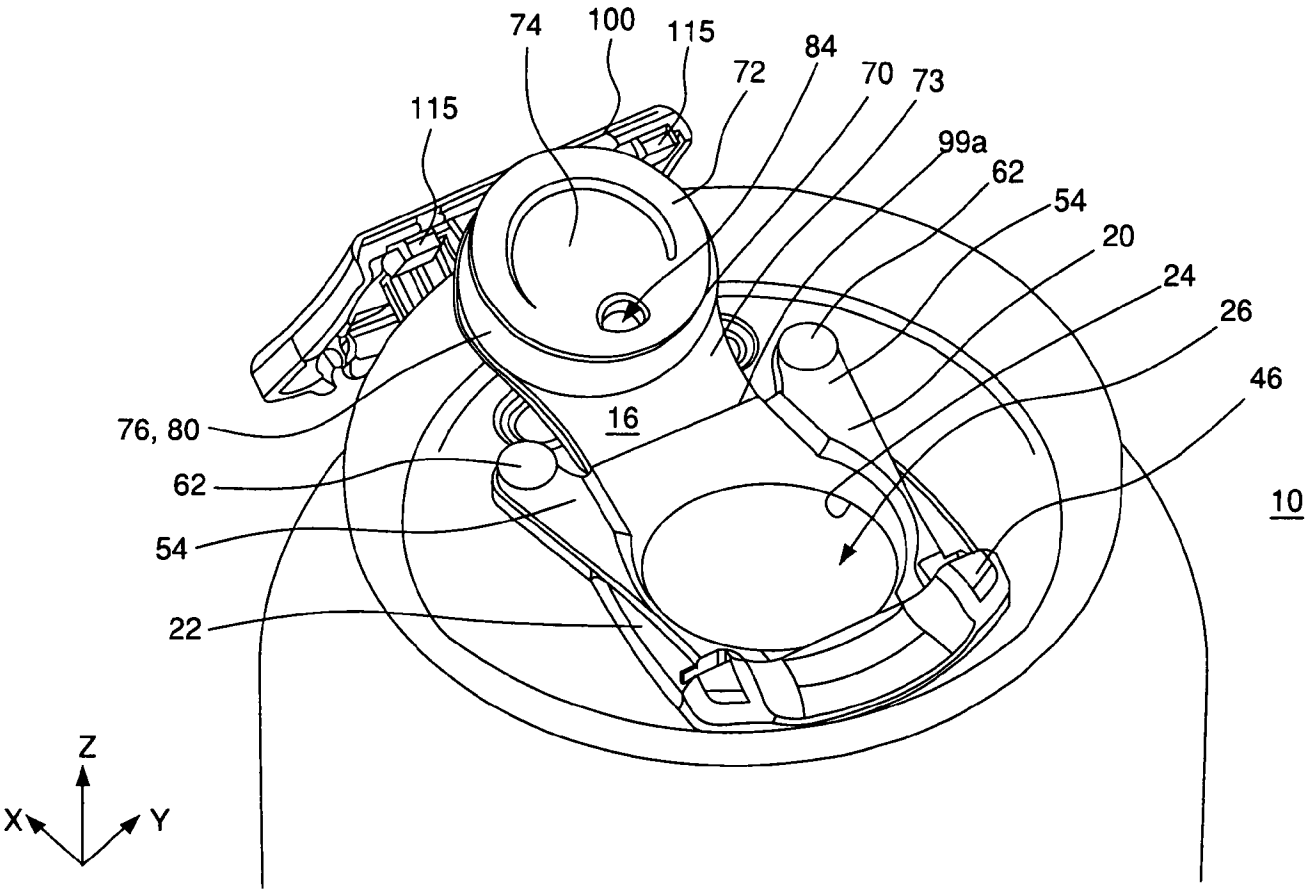
FIG. 4 is a perspective view of the package of FIG. 1 illustrating the closure in its fully open position.
Figure 5:
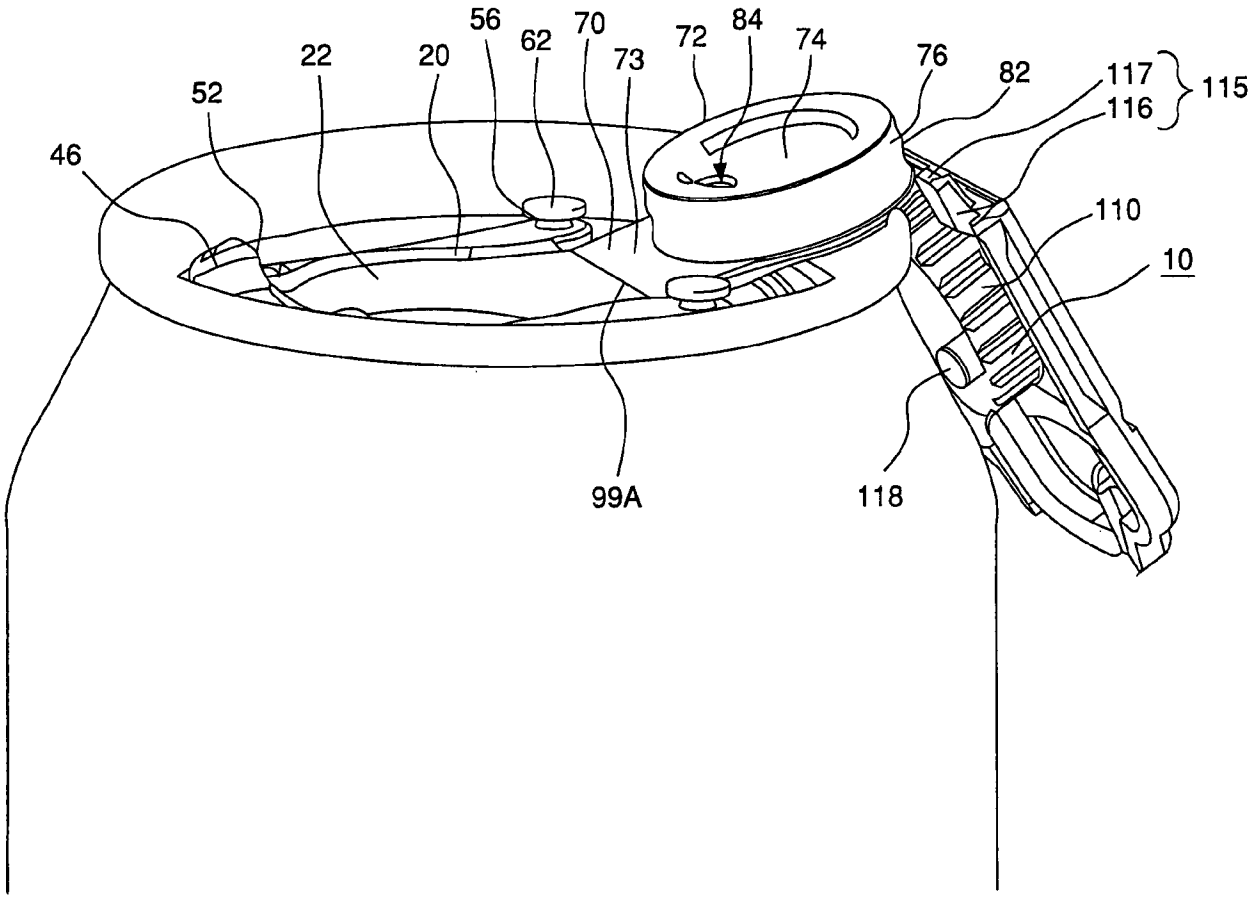
FIG. 5 is another perspective view of the package of FIG. 1 illustrating the closure in its fully open position.

From the position shown in FIG. 3, a user may further open closure 16 by continuing to pivot top plate 100 and may grasp top plate 100 or tab 120 and pull plug 72 fully from opening 26. FIGS. 4, 5, and 9 illustrate closure 16 in its fully open position, and illustrate a clipped open position in which closure 16 is retained on seam 18 in the fully open position in which plug is spaced apart from opening 26. The figures illustrate a portion of top plate 100, such as support ring 106 contacting the outside (near the underside) of seam 18 to retain closure 16 in its fully open position. Any portion of closure 16 (such as prongs 115) may contact seam 18 or any other portion of the can package to retain closure 16 in its fully open position.

To reclose closure 16, a user unclips top plate 100 from seam 18 and guides or folds plug 72 into opening 26. Plug 72 readily fits into aperture 26 because the outer diameter of aperture 26 is less than the inner diameter of aperture. Taper 32 of hoop inner sidewall 28 guides plug 72 to aperture 26 if necessary, and the relatively thin plug sidewall 76 enables some deformation of plug 72 if necessary. The tapered tip 119 of stopper 118 and the tapered surface of the upper portion of vent hole 84 guide stopper 118 into vent hole 84

Prongs 115 may be inserted into recesses 44. Then upon pushing down on top plate 100, a lever with great mechanical advantage is formed as body 116 of prong 115 pivots on the underside 50 or front rim 52 of overhang 46. This lever action enables closing of closure 16 even by users with slight hand strength. Further, the rear portion of support ring lip 114 contact ramp 90 and may impart a force (with large mechanical advantage) on the rear portion of plug 72 to urge plug 72 into opening 26.

Closure 16 only closes to the first open position (as illustrated in FIGS. 2, 7, and 11) because stake head 62 cannot be forced through hole 126 of tab 120 without visibly damaging contact surfaces 128. The position of tab 120 is its first open position provides evidence of prior opening, and provides tamper evidence. In this regard, the position illustrated in FIGS. 2, 7, and 11 may also be referred to as the reclosed position.

A method of applying closure 16 to an unseamed can end begins with closure 16 in its as molded state, which will be referred numeral 16'. Closure 16' is positioned on the unseamed can end 14' such that (as yet) undeformed hoop 24' is located in aperture 206. A cylindrical tool in inserted into hoop 24' to prevent or limit inward deflection, and opposing tools deform hoop 24 to form flange 34. An upper tool contacts the upper surface 207 and a punch contacts the bottom of hoop 24'. Preferably, the punch has alternating peaks and valleys, which enables deformation of hoop 24' at a lower total force. Preferably, both the tool and the closure are at or near ambient temperature (and are unheated), which simplifies application of closure 16'. The lower application force (compared with a punch having a flat face rather than peaks and valleys) is beneficial to prevent or diminish the deformation of curl 212 caused by radially outward deformation of hoop 24'.

Figure 13:
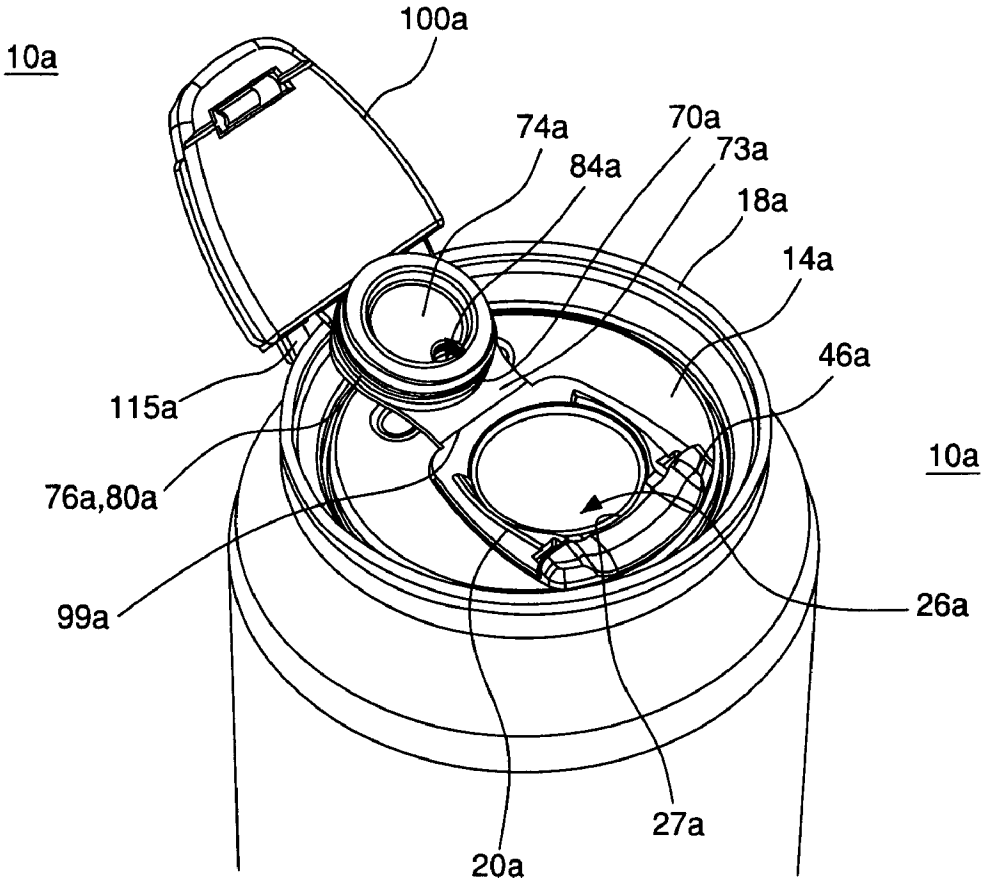
FIG. 13 is a perspective view of a package illustrating a second embodiment of the present invention in its fully open position.
Figure 14A:
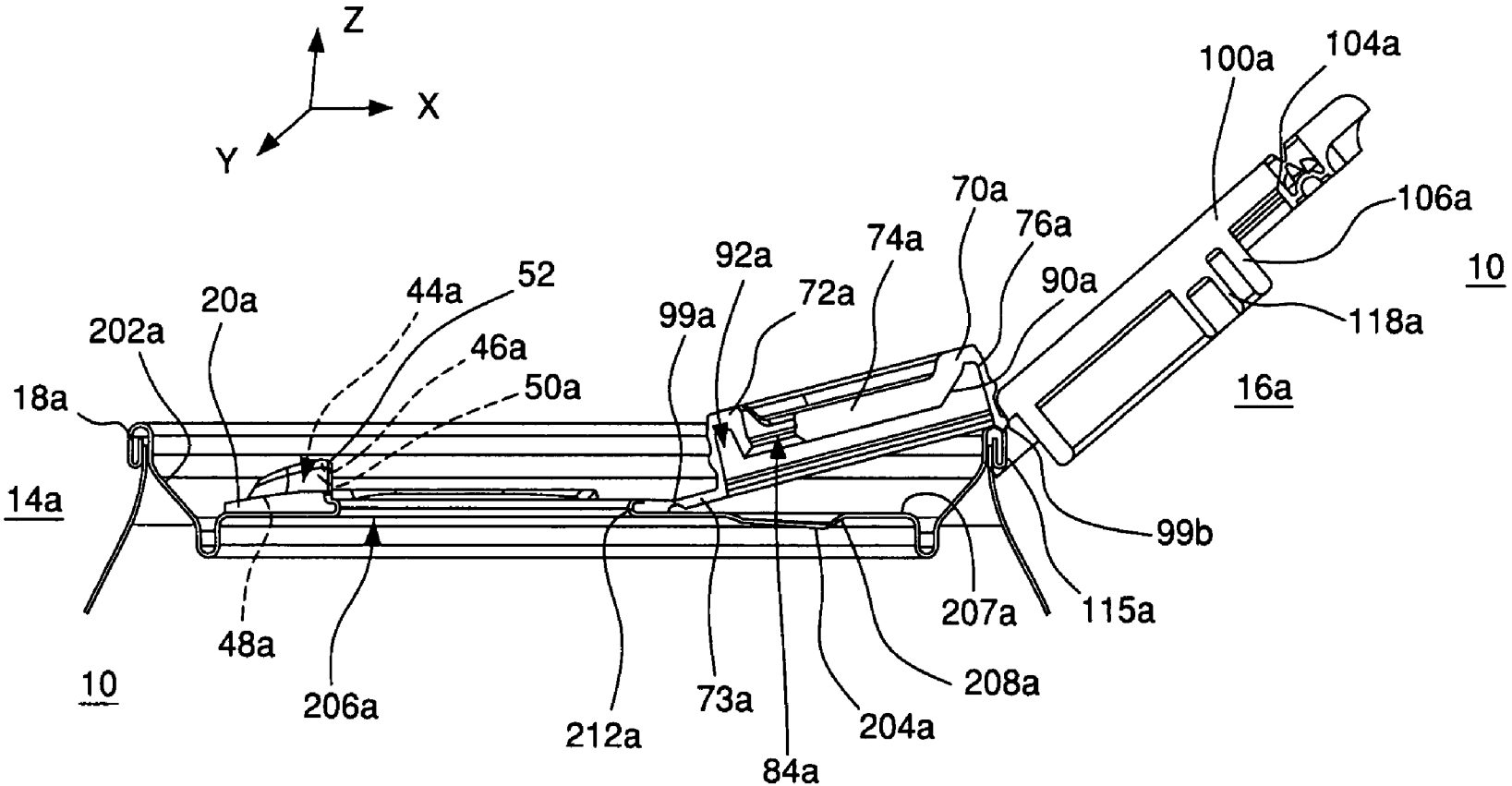
FIG. 14A is a cross sectional view of the package shown in FIG. 13 in its fully open position.
Figure 14B:
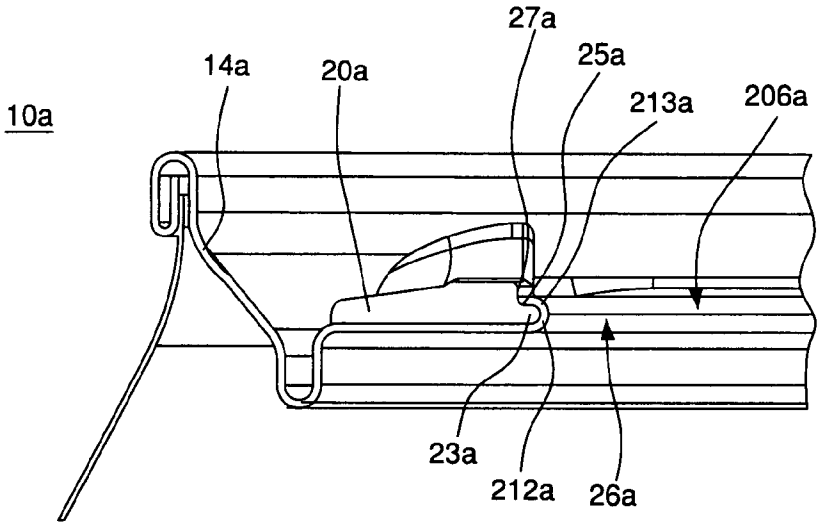
FIG. 14B is an enlarged view of a portion of the package shown in FIG. 14A.
Figure 15A:
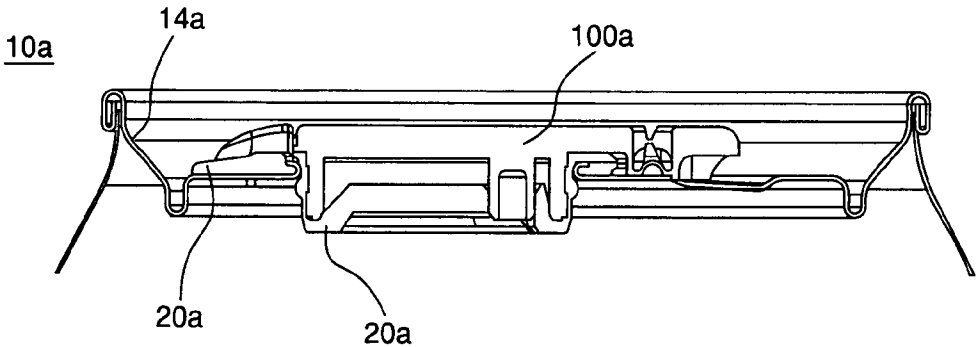
FIG. 15A is a cross sectional view of the package shown in FIG. 13 in its fully closed position.
Figure 15B:
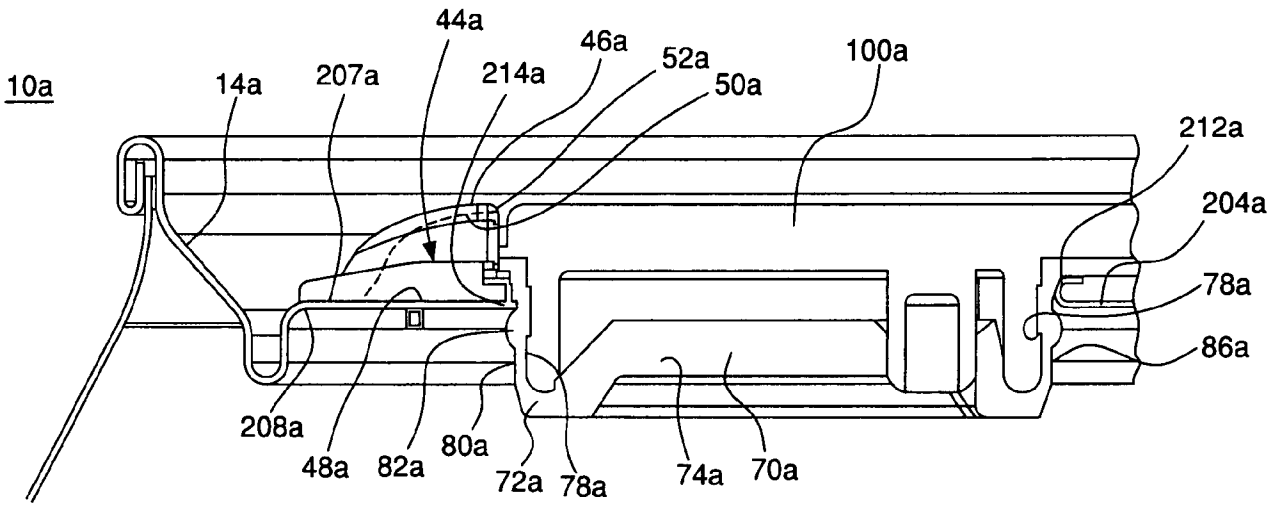
FIG. 15B is an enlarged view of a portion of the package shown in FIG. 15A in an unpressurized state.
Figure 15C:
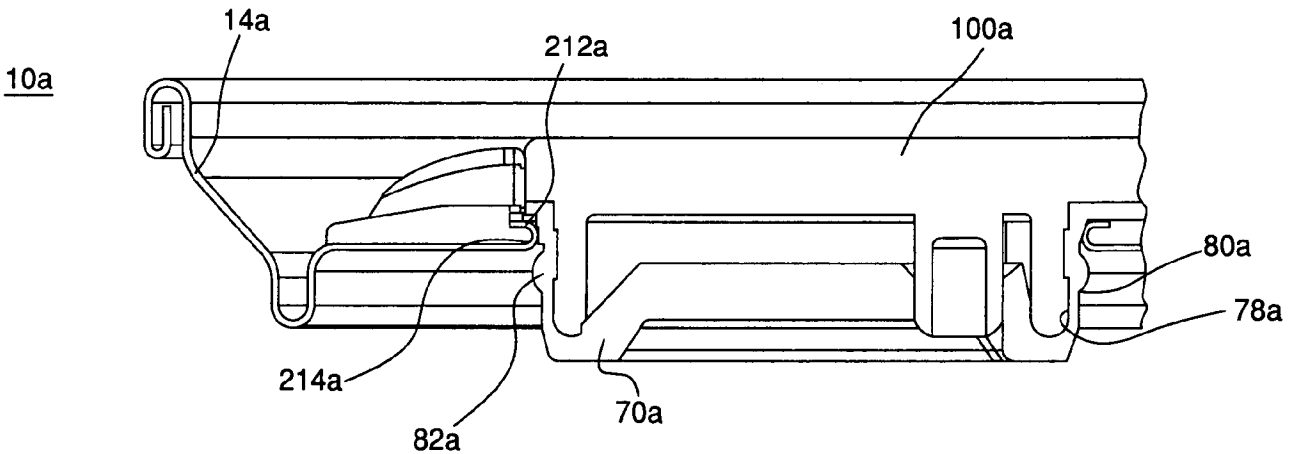
FIG. 15C is an enlarged view of a portion of the package shown in FIG. 15A in a pressurized state.

FIGS. 13 through 15 C illustrate a second embodiment 16*a* of a resealable closure. As shown for example in FIGS. 14A and 14B, can end 14*a* includes a peripheral wall 202*a* that extends into seam 18*a*, a center panel 204*a*, and an aperture 206*a* formed in the center panel. Can end 14*a* is shown only in its seamed state in FIGS. 13 through 15C; in its unseamed state, can end 14*a* has a peripheral curl, as described above. Can end 14*a* and closure 16*a* form package 10*a*.

Center panel 204*a* includes an upper surface 207*a* and a lower surface 208*a*. A curl 212*a* is formed about the inner periphery of aperture 206*a*. Preferably, curl 212*a* extends directly from a planar and horizontal portion of center panel 204*a* without a raised or vertical wall section (in transverse cross section). Curl 212*a* is more fully described below. The present invention encompasses can ends of any configuration, including for example can ends having a spout portion on which the curl is formed, ends that form a dome shape, and other configurations. Accordingly, the term "center panel" as used herein is not limited to flat or planar surfaces of a conventional beverage can ends.

As shown in FIGS. 13 through 15C, closure 16*a* is formed of a single plastic piece. Closure 16*a* includes a base plate 20*a*, a middle plate 70*a*, and a top plate 100*a*. A first hinge 99*a* connects base plate 20*a* to middle plate 70*a* and a second hinge 99*b* connected middle plate 70*a* to top plate 100*a*.

As best shown in FIG. 14B, base plate 20*a* includes circular rim 23*a* that defines an opening. Curl 212*a* is formed over rim 23*a* and includes an upper portion 213*a* that is located on or overtop of the upper surface 25*a* of rim 23*a*. Base plate 20*a* includes a circular sidewall 25*a* that extends upwardly from upper face 25*a*. Preferably, the edge of curl upper portion 213*a* is spaced apart from sidewall 25*a*.

Recesses 44*a* are formed in upper portion 22*a* at the rear of base 20*a*. Recess 44*a* is shown schematically in dashed lines in FIG. 15B. As described for the first embodiment closure 16 and indicated on FIG. 14A, each recess 44*a* includes an overhang 46*a*, a floor 48*a*, an underside 50*a* of overhang 46*a*, and a front lip or front face 52*a*.

Middle plate 70*a* includes a plug 72*a* from which a flange 73*a* extends. Flange 73*a* is connected to base plate 20*a* by hinge 99*a*. Plug 72*a* includes a plug panel 74*a* that is approximately circular, and a peripheral plug sidewall 76*a* that extends upwardly from plug panel 74*a*. Panel 74*a* is raised relative to the bottom end of sidewall 76*a* such that a circumferential groove 92*a* extends around panel 74*a*.

Plug panel 74*a* has a vent hole 84*a*, an incline or ramp 90*a*, like corresponding vent hole 84*a* and ramp 90*a* described for first embodiment closure 16. As best shown in FIGS. 15B and 15C, plug sidewall has an inner surface 78*a* and an outer surface 80*a*, which includes a circumferential rib 82*a* that protrudes from the surface of outer surface 80*a*.

Top plate 100*a* is connected to middle plate 70*a* by a hinge 99*b*, and includes a top panel 102*a* having a lip or edge 104*a* at a front portion thereof, a circular support ring 106*a*, and a cylindrical stopper 118*a* as described for first embodiment top plate 100. Second embodiment 16*a* is shown without stakes, although stakes and like tamper evident features may be employed. A pair of prongs 115*a* extends from the rear of top plate panel 102*a*, as described for first embodiment top plate 100*a*.

FIG. 15B shows closure 16*a* in its closed, unpressurized state; FIG. 15C shows closure 16*a* in its closed state and having an internal pressure generally consistent with that encountered in the carbonated soft drink industry. In FIG. 15C, the internal pressure has forced plug 72*a* upward such that an upper portion of bead 82*a* is urged against a lower portion 214*a* of bead 212*a* to enhance sealing therebetween. Support ring 106*a* prevents plug sidewall 76*a* from flexing radially inwardly such that radially flexing, if any, will be radially outwardly to further enhance the seal between bead 82*a* and curl 212*a*. Because they contact curl 212*a*, which is metal (preferably aluminum), plug sidewall 76*a* and bead 82*a* deform upon contact with curl 212*a*, which enhances the sealing compared with plastic to plastic contact.

To form closure 16*a*, and can end (not shown in its finished state) is formed having and an aperture is cut in the center panel 204*a*. A ring-like vertical wall is formed at the periphery of the aperture. Closure 16*a* is positioned on upper surface 207*a* of center panel 204*a*, and the vertical wall is crimped radially outwardly and downwardly over rim 23*a* to form curl 212*a* secure closure 16*a* to center panel 204*a*.

The closure, such as closure 16*a*, preferably is formed by injection molding with a single sprue location on plug panel 74*a*. The plastic flows splits to flow around the opening and rim 23*a* of base plate 20*a* to meet at a reweld location 27*a*, as indicated on FIG. 13. The reweld 27*a* may create a ridge or other shape or geometry. The crimping of curl 212*a* onto rim 23*a* diminishes the effect of reweld 27*a*.

Figure 16:
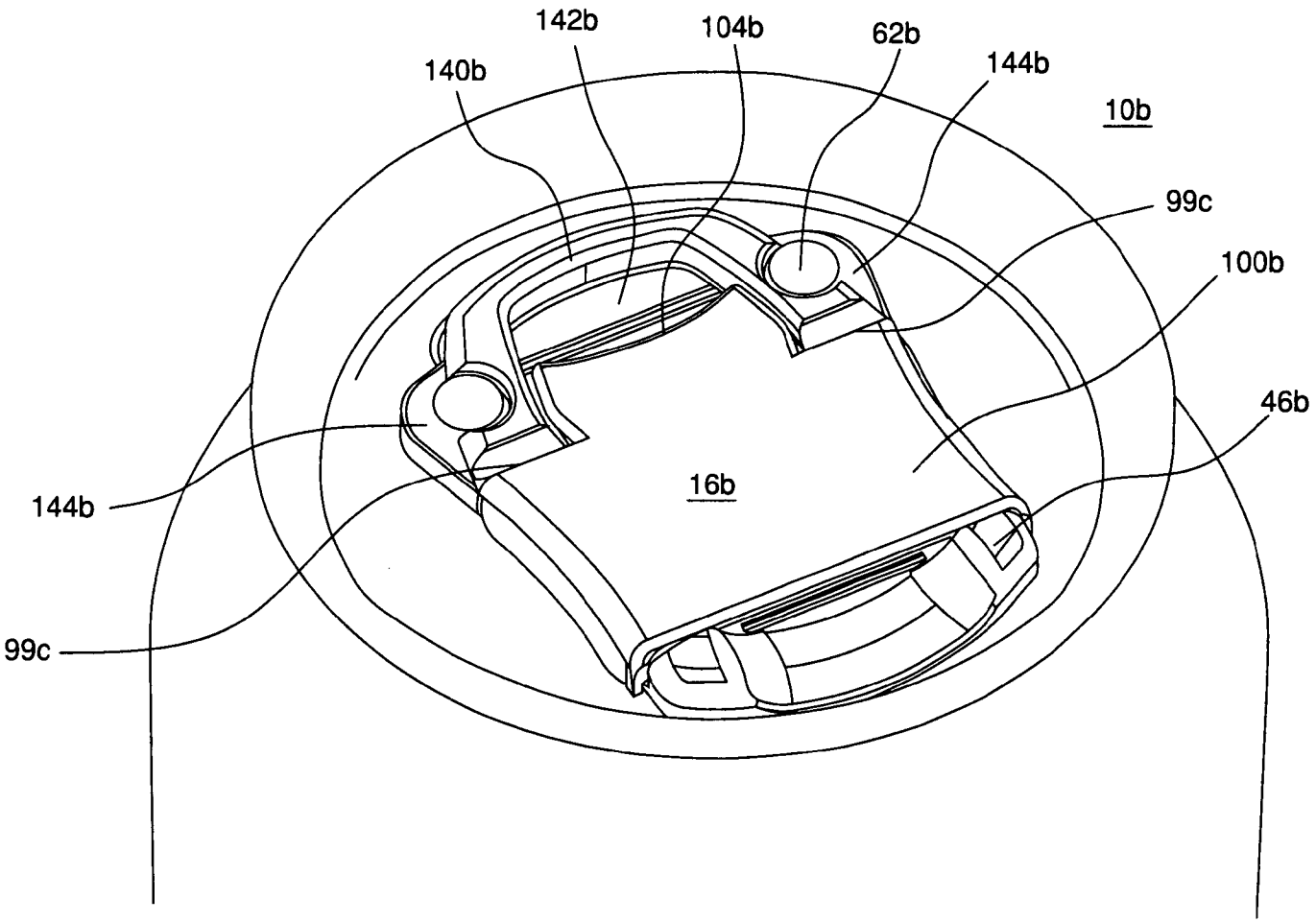
FIG. 16 is a perspective view of the package illustrating a third embodiment of the closure in its fully closed position.
Figure 17:
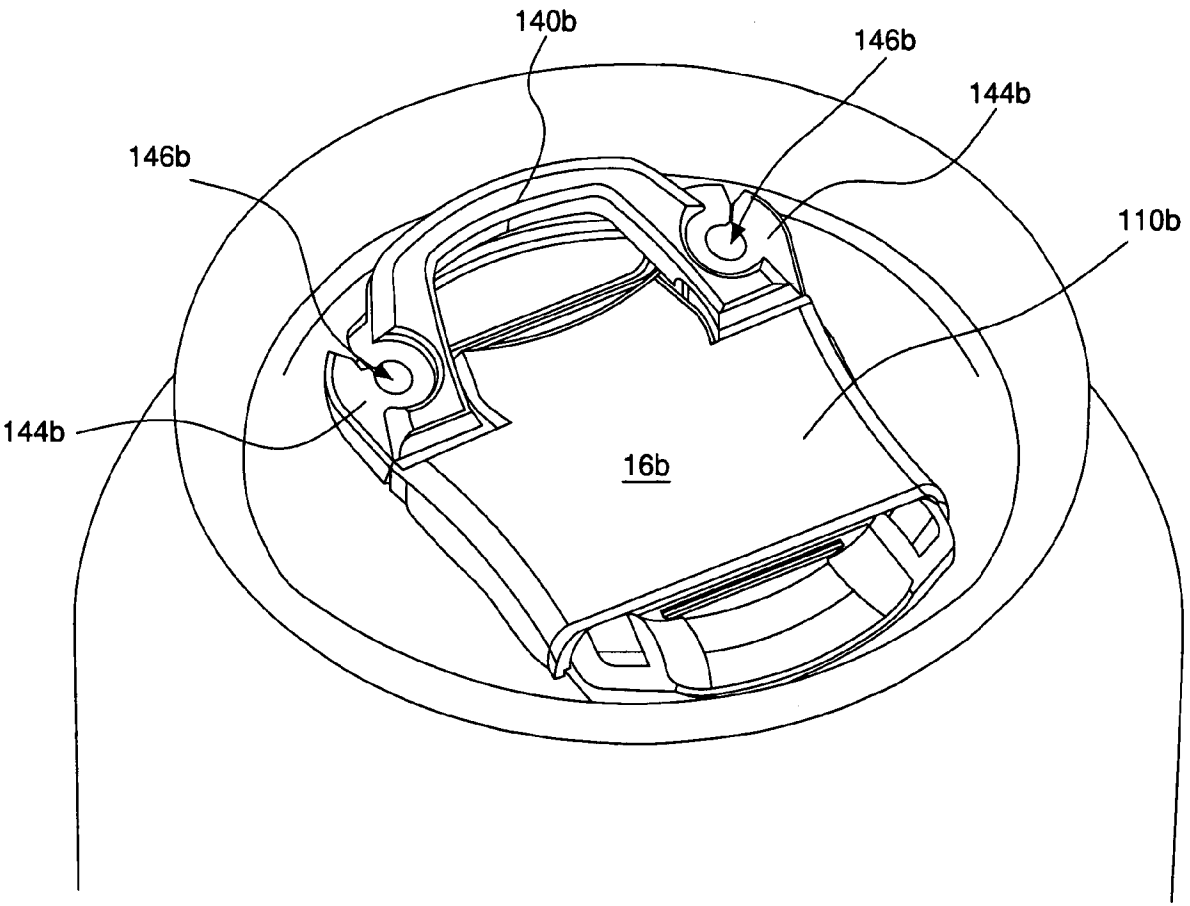
FIG. 17 is a perspective view of the third embodiment package of FIG. 16 illustrating a first stage of the opening process, and illustrating the reclosed position.
Figure 18:
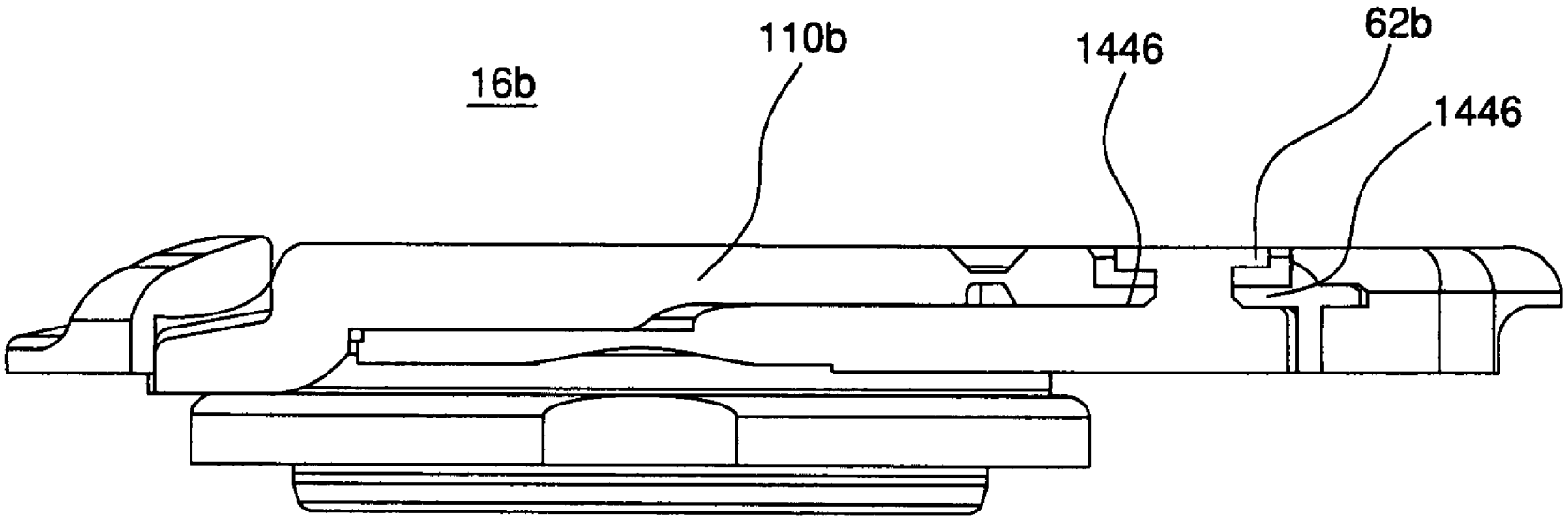
FIG. 18 is a cross section view of the third embodiment package in it fully closed position.

FIGS. 16, 17, and 18 illustrate a third embodiment 16*b* of the resealable closure. Preferably, base plate 20*b*, middle plate 70*b*, and top plate 100*b* are the same for closure 16, as described above for the first embodiment closure. Third embodiment closure 16*b* has a tab 140*b* that extends from the front edge 104*b* of top plate 10*b*. Tab 140*b* is connected to top plate 100*b* by a pair of opposing hinges 99*c*. A hollow or cutout 142*b* is formed between the body of tab 140*b* and top plate front edge 104*b*. A pair of webs 144*b* extends outwardly from the body of tab 140*b*. Each web 144*b* is a thin member in which an aperture 146*b* is formed. Stake 56*b* extends through aperture 146*b* and has a head 62*b* that is located above web 144*b*. Web 144*b* ruptures upon initial opening of closure 16*b* to provide tamper evidence.

Figure 12:
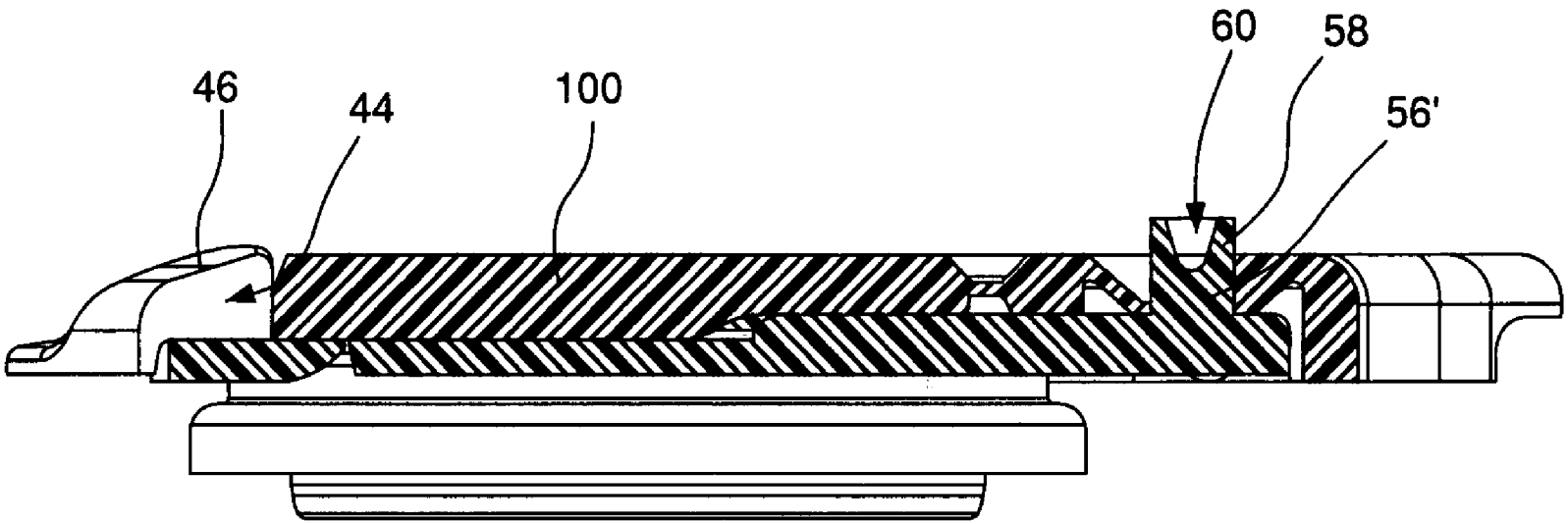
FIG. 12 is a cross sectional view of the closure shown in FIG. 10 illustrating the stake in its undeformed state.

Referring generally to the figures, and particularly to FIGS. 10, 11, and 12, a method of providing tamper evidence by deforming a stake includes providing a closure 16 (or any of the other embodiments describe above) in which the stake is in its as-molded, undeformed state, which is shown in FIG. 12 and referred to by reference numeral 56'. Undeformed stake 56' has a body that extends upwardly to a distal tip 58 having a depression or recess 60 formed in its center. The recess enhances the ability of tip 58 to deform when pressed with a cold (that is, room temperature or unheated) tool. Preferably, closure 16 is unheated.

The present invention is illustrated by referring to the embodiments described herein. Features of any of the embodiments may be added or subtracted to any other embodiment, as the description of the embodiments is illustrative. The present invention is not limited to the particular structure or function of the embodiments, but rather encompasses the structure and function defined in the claims, as will be understood by persons familiar with plastic closures and metal beverage cans in view of the present disclosure.

We claim:

1. A can end combination comprising a metal can end and resealable closure coupled to the can end, the can end comprising a peripheral wall and a center panel, the center panel including an upper surface, an opposing lower surface, and an aperture formed therethrough;

the closure comprising:

a base plate that is coupled to the can end center panel and includes a recess formed therein and an opening formed therein;

a middle plate including a plug, the middle plate being connected to the base plate by a first hinge; and a top plate including at least one prong, the top plate being connected to the middle plate by a second hinge;

at least one of the can end aperture and the closure base plate forming a pour opening;

the closure configured to have (i) a fully closed position in which the base plate, middle plate and top plate are in mutual contact, the plug is located in the pour opening to obstruct the pour opening, and the at least one prong of the top plate is located in the recess of the base plate, (ii) a intermediate position in which at least the top plate is in an oblique position relative to horizontal, (iii) a fully open position in which the plug is spaced apart from the pour opening and the prong is spaced apart from the recess, and (iv) a reclosed position that is enabled after initial opening and in which the plug is located in the pour opening to obstruct the pour opening, and the at least one prong is located in the recess;

whereby the top plate pivots between the fully open position and the reclosed position and the prong forms a lever as the plate pivots between the fully open position and the reclosed position to thereby enhance the closing process of the closure.

2. The can end combination of claim 1 wherein an extension of the closure base plate extends through the aperture in the can end and includes a hoop configured to have a sidewall that defines the pour opening, and the plug is located in the pour opening when the closure is in its fully closed position.

3. The can end combination of claim 1 wherein the base plate includes a rim at a periphery of the opening, and the can end includes a curl that extends over at least a portion of the periphery.

4. The can end combination of claim 3 wherein the curl defines the pour opening such that the plug contacts the curl when the closure is in its fully closed position.

5. The can end combination of claim 4 wherein the seal is formed by plastic to metal contact.

6. The can end combination of claim 5 wherein the rim of the base plate has at least one reweld location, the metal-to-plastic contact between the curl and the rim diminishes the effect of the reweld location.

7. The can end combination of claim 4 wherein the plug has a sidewall configured to have a bead capable of contacting the curl when the closure is in its fully closed position.

8. The can end combination of claim 1 wherein the base plate includes an overhang that forms the recess.

9. The can end combination of claim 1 wherein the at least one prong contacts a bottom surface of the recess as the top plate is moved from its fully closed position to its intermediate position.

10. The can end combination of claim 9 wherein the bottom surface of the recess is formed by the upper surface of the can end center panel.

11. The can end combination of claim 9 wherein the at least one prong is a pair of prongs at a foot of the top plate and the recess is a pair of recesses formed at a rear of the base plate.

12. The can end combination of claim 10 wherein distal tips of the prongs slide on the upper surface of the can end while the top plate moves from its fully closed position to the intermediate position.

13. The can end combination of claim 9 wherein the top plate pivots and upwardly translates while the top plate moves from its fully closed position to the intermediate position.

14. The can end combination of claim 13 wherein the movement of the top plate toward the intermediate position lifts at least a portion of the plug from the pour opening.

15. The can end combination of claim 9 wherein the at least one prong is inserted into the recess and an upper surface of the prong contacts the underside surface of the recess during the closing process to the reclosed position.

16. The can end combination of claim 1 wherein the top plate includes a ring extending downwardly from an underside thereof, the ring contacting an inside surface of the plug while the closure is in the fully closed position.

17. The can end combination of claim 1 wherein the plug includes a plug panel and a peripheral sidewall.

18. The can end combination of claim 17 wherein the plug panel has a radial thickness that is greater than a radial thickness of the plug sidewall.

19. The can end combination of claim 17 wherein the plug sidewall has an outside diameter that is less than an inner diameter of the pour opening.

20. The can end combination of claim 19 wherein the top plate includes a ring extending downwardly from an underside thereof, the ring configured to have an outside diameter that is greater than an inside diameter of the plug sidewall.

21. The can end combination of claim 20 wherein the ring has a radial thickness that is greater than the radial thickness of the plug sidewall.

22. The can end combination of claim 20 wherein the ring extends into the plug while the closure is in its fully closed position such that an outside surface of the ring urges the plug sidewall radially outwardly into contact with the pour opening sidewall.

23. The can end combination of claim 22 wherein the middle plate includes a vent hole and the top plate includes a vent hole stopper that is located in the vent hole to seal the vent hole while the closure is in its fully closed position.

24. The can end combination of claim 23 wherein the ring includes vents formed therein for enabling communication across the ring for releasing pressure upon release of the vent hole stopper from the vent hole.

25. The can end combination of claim 1 wherein the base plate includes a downwardly extending hoop that extends through the aperture in the can end center panel, the hoop configured to have a bottom flange that extends radially outwardly to clamp the base plate to the can end center panel, a bottom surface of the flange configured to have alternating peaks and valley formed therein during application of the closure to the can end, whereby clamping is enhanced.

26. The can end combination of claim 1 wherein the base plate includes a stake protruding from the base plate that engages the top plate while the closure is in the fully closed position, the stake becoming disengaged from the top plate upon moving the top plate from the fully closed position toward the intermediate position, thereby providing tamper evidence.

27. The can end combination of claim 26 wherein the stake includes a rivet head that protrudes through an aperture in the top plate to engage the top plate.

28. The can end combination of claim 27 wherein the aperture includes a countersink in which the rivet head is disposed while the closure is in its fully closed position, the rivet head being pulled through the aperture upon moving the closure from its fully closed position toward its intermediate position.

29. The can end combination of claim 28 wherein the rivet head is not insertable into the countersink after initial opening of the closure such that the head is not located in the countersink while the closure is in the reclosed position.

30. The can end combination of claim 27 wherein the top plate includes a web in which at least a part of the aperture is formed, a rivet head is located in or above the web while the closure is in its fully closed position, such that the web is ruptured upon moving the closure from its fully closed position toward its intermediate position.

31. The can end combination of claim 1 wherein the plug includes a ramp, and a portion of a rim of the ring of the top plate contacts the ramp to enhance insertion of the plug into the pour opening while the closure is moved toward the reclosed position.

32. The can end combination of claim 1 wherein the closure is formed as a single unit.

33. A package comprising a can body and the can end combination of claim 1, the can end being attached to the can body by a seam.

34. The package of claim 33 wherein the at least one prong contacts a seam that couples the can end to the can body, such that the top plate and middle plate are releasably retained and spaced apart from the pour opening.

35. The package of claim 33 wherein a foot of the top plate contacts a seam that couples the can end to the can body, such that the top plate and middle plate are releasably retained and spaced apart from the pour opening.

* * * * *